US010329863B2

(12) United States Patent
Rodriguez

(10) Patent No.: US 10,329,863 B2
(45) Date of Patent: Jun. 25, 2019

(54) AUTOMATIC DRILLER

(71) Applicant: Alejandro Rodriguez, The Woodlands, TX (US)

(72) Inventor: Alejandro Rodriguez, The Woodlands, TX (US)

(73) Assignee: A&O TECHNOLOGIES LLC, The Woodlands, TX (US)

( * ) Notice: Subject to any disclaimer, the term of this patent is extended or adjusted under 35 U.S.C. 154(b) by 851 days.

(21) Appl. No.: 14/135,740

(22) Filed: Dec. 20, 2013

(65) Prior Publication Data

US 2015/0041137 A1 Feb. 12, 2015

Related U.S. Application Data

(63) Continuation-in-part of application No. 13/959,912, filed on Aug. 6, 2013, now abandoned.

(51) Int. Cl.

| | |
|---|---|
| ***E21B 23/00*** | (2006.01) |
| ***E21B 31/00*** | (2006.01) |
| ***E21B 4/04*** | (2006.01) |
| ***E21B 33/12*** | (2006.01) |
| ***E21B 41/00*** | (2006.01) |
| ***E21B 43/11*** | (2006.01) |
| ***E21B 43/112*** | (2006.01) |
| ***E21B 43/14*** | (2006.01) |
| ***E21B 7/00*** | (2006.01) |

(52) U.S. Cl.

CPC ..... *E21B 31/002* (2013.01); *E21B 4/04* (2013.01); *E21B 7/00* (2013.01); *E21B 33/12* (2013.01); *E21B 41/00* (2013.01); *E21B 43/11* (2013.01); *E21B 43/112* (2013.01); *E21B 43/14* (2013.01); *E21B 2023/008* (2013.01)

(58) Field of Classification Search

CPC combination set(s) only.
See application file for complete search history.

(56) References Cited

U.S. PATENT DOCUMENTS

| | | | | |
|---|---|---|---|---|
| 2,210,125 A | | 8/1940 | Raymond et al. | |
| 3,038,333 A | | 6/1962 | C et al. | |
| 3,138,206 A | | 6/1964 | Bruce et al. | |
| 3,378,069 A | | 4/1968 | Q | |
| 4,373,582 A | * | 2/1983 | Bednar | E21B 21/103 166/321 |
| 4,676,310 A | | 6/1987 | Scherbatskoy et al. | |

(Continued)

OTHER PUBLICATIONS

Baker Hughes, New Hornet MD 6K Retrievable Packer Combines Highest Standards for Reliability With Lower Cost for Moderate Environments, 2003.

(Continued)

*Primary Examiner* — Giovanna C Wright
*Assistant Examiner* — Ronald R Runyan
(74) *Attorney, Agent, or Firm* — Nolte Intellectual Property Law Group

(57) ABSTRACT

An automatic drilling apparatus having a tool body, a motive device connected to the tool body, and a drill bit connected to the tool body. The apparatus also includes a setting tool connected to the body, at least one sensor disposed on the tool body, and a computer disposed in the tool body, wherein the computer is configured to actuate the motive device, the drill bit, the setting tool, and the at least one sensor.

20 Claims, 30 Drawing Sheets

(56) References Cited

U.S. PATENT DOCUMENTS

| | | | | |
|---|---|---|---|---|
| 4,745,971 | A | 5/1988 | Akkerman | |
| 5,469,916 | A | 11/1995 | Sas-Jaworsky et al. | |
| 6,046,685 | A | 4/2000 | Tubel | |
| 6,142,245 | A * | 11/2000 | Best | E21B 4/18 175/57 |
| 6,196,336 | B1 * | 3/2001 | Fincher | E21B 4/18 175/101 |
| 6,272,434 | B1 | 8/2001 | Wisler et al. | |
| 6,378,627 | B1 | 4/2002 | Tubel et al. | |
| 6,953,094 | B2 | 10/2005 | Ross et al. | |
| 7,055,625 | B1 * | 6/2006 | Myrick | E21B 49/06 175/26 |
| 7,219,725 | B2 | 5/2007 | Chisholm | |
| 7,322,416 | B2 | 1/2008 | Wesley et al. | |
| 7,615,900 | B1 * | 11/2009 | Harris | H02K 35/02 310/166 |
| 2002/0162657 | A1 | 11/2002 | Tumlin et al. | |
| 2003/0141078 | A1 | 7/2003 | Mackenzie | |
| 2003/0234110 | A1 | 12/2003 | McGregor | |
| 2004/0216925 | A1 | 11/2004 | Metcalfe et al. | |
| 2006/0198708 | A1 | 9/2006 | Krenzer et al. | |
| 2009/0188665 | A1 | 7/2009 | Tubel et al. | |
| 2009/0294119 | A1 | 12/2009 | Burnett et al. | |
| 2010/0212964 | A1 | 8/2010 | Beuershausen | |
| 2013/0283618 | A1 * | 10/2013 | Wiliams | B27F 7/003 29/897.32 |

OTHER PUBLICATIONS

Baker Hughes, Packer Systems, Completions and Production, 2010.
Baker Hughes, Wireline/workstring set packers, 2013.
International Search Report of the International Searching Authority (USPTO) for international application PCT/US2014/45728 dated Jan. 12, 2015.
International Search Report of the International Searching Authority (USPTO) for international application PCT/US2014/45740 dated Jan. 21, 2015.
Written Opinion of the International Searching Authority (USPTO) for international application PCT/US2014/45728 dated Jan. 12, 2015.
Written Opinion of the International Searching Authority (USPTO) for international application PCT/US2014/45740 dated Jan. 21, 2015.

* cited by examiner

AUTOMATIC DRILLER

CROSS-REFERENCE TO RELATED APPLICATIONS

This application claims the benefit pursuant to 35 U.S.C. § 120, as a continuation-in-part application of U.S. application Ser. No. 13/959,912 filed Aug. 6, 2013. This application is incorporated by reference in its entirety.

BACKGROUND OF THE INVENTION

A producing well extracts oil and/or natural gas from one or more subsurface reservoirs of hydrocarbons. The development of a producing well includes drilling a borehole into the subsurface ground, casing the drilled borehole or leaving the borehole uncased, and completing the borehole to enable production.

After drilling a well for hydrocarbons, it may be necessary to perforate the walls of the well to facilitate flow of hydrocarbons into the well. Wells require perforation because the drilling process causes damage to the formation immediately adjacent to the well. This damage reduces or eliminates the pores through which the oil or gas would otherwise flow. Perforating the well creates a channel through the damage to undamaged portions of the formation. The hydrocarbons flow through the formation pores into the perforation channels and through the perforation channels into the well itself.

Traditional methods of perforating the well (both casing and the formation) involved lowering tools that contain explosive materials into the well adjacent to the hydrocarbon bearing formation. Discharge of the explosive would either propel a projectile through the casing and into the formation or, in the case of shaped charges, directly create a channel with explosive force. Such devices and methods are well known in the art.

In vertical wells, gravity may be used to lower the perforating device into position with wireline being used to hold the device against gravity and retrieve the device after discharge. For lateral wells, which may be horizontal or nearly horizontal, gravity may only be used to lower the perforating device with wireline to a point where the friction of the device against the well bore overcomes the gravitational force. The perforating device must then be either pushed or pulled along the lateral portion of the well until the device reaches the desired location.

Along with perforating the formation, packers may be used to isolate a section of the well for selective production and/or other downhole operations. A packer is a common downhole tool used in both the drilling and completion of a well. A packer typically has a sealing element, a holding or setting device, and a fluid passageway. Packers may be, but are not limited to, pneumatically or hydraulically expandable, swellable through use of a fluid, or expanded through fluid diffusion. Additionally, packers may seal through an elastomeric element that is solid and expands outwards under axial compression or tension. Production packers are used in completions to isolate an annulus between the casing or liner and the production tubing; and also between the open hole and a wellbore section. By creating a seal in the annulus, production control is achieved and tasks such as testing, fluid injection, perforation, treatment, and zonal isolation can be accomplished.

Expandable packers may be used for different sealing and partitioning purposes in boreholes. Typically, an annular packer is connected to a pipe, such as a production or injection pipe, which is run into the borehole, after which, the annular packer is expanded against the formation wall or against a casing. Smaller packers may also be used within smaller tubulars within a wellbore to achieve desired sealing and partitioning.

BRIEF SUMMARY OF THE INVENTION

According to one aspect of one or more embodiments of the present invention, an automatic drilling apparatus having a tool body, a motive device connected to the tool body, and a drill bit connected to the tool body. The apparatus also includes a setting tool connected to the body, at least one sensor disposed on the tool body, and a computer disposed in the tool body, wherein the computer is configured to actuate the motive device, the drill bit, the setting tool, and the at least one sensor.

According to one aspect of one or more embodiments of the present invention, a method of clearing an obstruction from a well, the method including disposing an automatic driller in a well, wherein the automatic driller has a tool body, a drill bit, a setting tool, a motive device, at least one sensor, and a computer. The method further includes detecting an obstruction with the sensor, actuating the drill bit, and clearing the obstruction with the drill bit.

According to one aspect of one or more embodiments of the present invention, a method of drilling a secondary borehole, the method including disposing an automatic drilling in a well, wherein the automatic driller includes a tool body, a drill bit, a setting tool, a motive device, at least one sensor, and a computer. The method further includes moving the automatic driller to a secondary borehole location within the well, deploying the setting tool, actuating the drill bit, and drilling a secondary borehole with the drill bit.

Other aspects of the present invention will be apparent from the following description and claims.

DETAILED DESCRIPTION OF THE INVENTION

Figure 1:
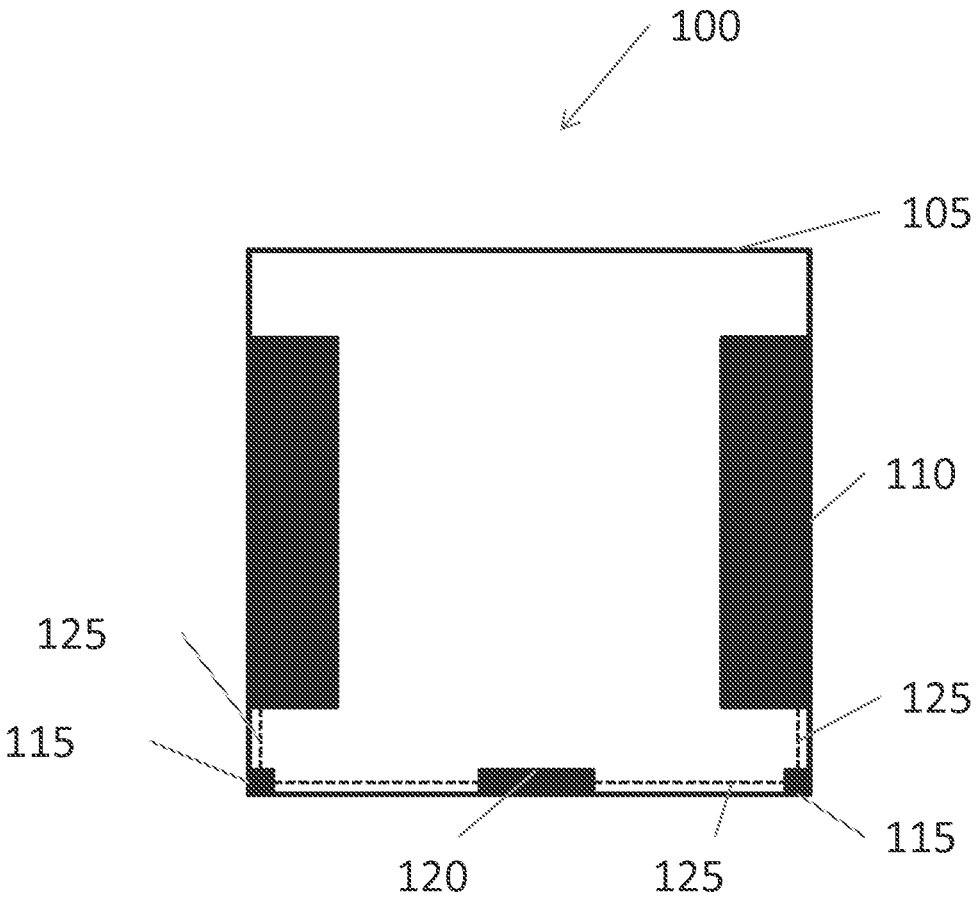
FIG. 1 is a cross-sectional view of an automatic packer according to embodiments of the present disclosure.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention.

FIG. 1 shows a cross-sectional view of an automatic packer 100 in an unactuated condition according to embodiment of the present disclosure. In this embodiment, automatic packer includes a tool body 105. The tool body 105 may be formed from various metals, metal alloys, and/or composites, such as polymers, carbon fiber, or Kevlar. For example, in one embodiment, tool body 105 may be formed from stainless steels, such as low alloy steels, e.g., 4140, Martensitic and PH stainless steels, e.g., 9Cr, 13Cr, 17-4PH, alloy 450, Super 13CR, and the like, nickel alloys, e.g., 825, 925, and 718, as well as nickel alloys, e.g., 625, 725, and C-276. In certain embodiments, portions or tool body 105 may be formed from cast iron, copper, bronze, and/or reinforced polymer-based composite. Tool body 105 may be of a generally cylindrical geometry such that tool body 105 may be disposed within a well or a wellbore.

Automatic packer 100 may further include at least one sealing element 110 disposed within tool body 105. Sealing element 110 may be formed from various rubbers and/or elastomeric materials. Examples of materials that sealing element 110 may be formed from include Nitrile, bonded Nitrile, Viton, Molyglass, etc. Generally, any material that has high strength and high resiliency, while not being adversely affected by thermal and/or chemical environments may be used.

Sealing element 110 may be disposed circumferentially around tool body 105, such that the sealing element 110 in a collapsed position, such as illustrated in FIG. 1, does not extend outside of the outers diameter of tool body 105. Thus, in certain embodiments, sealing element 110 may be disposed substantially within tool body 105 when automatic packer 100 is in a collapsed or unactuated condition. Automatic packer 100 may further include various other components, such as slips, slip assemblies, dogs, lockrings, seals, etc., that are not explicitly disclosed herein.

Automatic packer 100 may further include at least one sensor 115 disposed within tool body 105. Sensor may be disposed such that a portion of sensor 115 extends from within tool body 105 through outer diameter of tool body 105, thereby allowing sensor 115 to measure one or more conditions within the well. In some embodiments, sensor 115 may be disposed substantially within tool body 105 and not interact directly with the environment in the well. Sensor 115 may be configured to take measurements of one or more conditions within the well. For example, sensor 115 may be configured to measure a temperature, a pressure, a fluid type, a density, a specific gravity, an induction, a conduction, a refraction, infrared signal, a fiber optic signal, a load, an acceleration, a velocity, an ultrasonic signal, a tachometer measurement, a wireless transmission, a gyroscopic measurement, a casing collar locator, a modular reservoir dynamic test, and/or a position within the well. While automatic packer 100 is illustrated having two sensors 115, those of ordinary skill in the art will appreciate that a single sensor 115 may be used, as well as more than two sensors. For example, in a certain embodiment, automatic packer 100 may have a different sensor for each parameter that is being measure. In other embodiments, automatic packer 100 may include a single sensor that takes multiple measurements, or several sensors that take single or multiple parameter measurements. A casing collar locator is an electric logging tool that detects a magnetic anomaly caused by the relatively high mass of the casing collar. A signal may be sent from the casing collar locator to surface equipment that provides a display and printed log to a surface operator. The information provided to the surface operator allows the information to be correlated with previous logs and known casing features, such as pup joints, thereby allowing the surface operator to determine the location of the tool within the well.

Sensors 115 may be connected to a data controller 120. Data controller 120 may include a processor (not independently shown), memory (not independently shown), memory storage (not independently shown), and other components for processing and storing data measured by the at least one sensor 115. Examples of a data controller may include, for example, a programmable logic controller ("PLC"). As illustrated, sensors 115 may be connected to data controller 120 through wiring 125. In other embodiments, sensors 115 may be connected wirelessly to data controller 120. Sensors 115 may also be connected directly to sealing element 110, or a sealing element actuation mechanism (not independently shown) through additional wiring 125. Depending on the design requirements for automatic packer 100, sensors 115 may further be connected to various other components not expressly identified herein, thereby allowing automatic packer 100 to actuate based on parameters measured by sensors 115. The actuation of automatic packer 100 will be described further below.

Sensors 115 may be configure to take substantially continuous measurements, or alternatively, may be configured to take measurements at selected intervals, such as selected time intervals. Additionally, as sensors 115 take measurements, the measurements may be sent to data controller 120. Data controller 120 may include memory, as explained above, that is capable of storing the measurements. The stored data may be stored such that the data may be later downloaded at the surface for analysis or processing. Additionally, in certain embodiments, the measured data may be transmitted to the surface while automatic packer is downhole. In certain embodiments, the data transmission to the surface may occur through a wireline, e-line, wirelessly, through inductive pipe transmittance, plunger lift systems, etc. In some embodiments, a combination of both wired and wireless transmittance may be used to send signals to/from automatic packer 100 while downhole. For example, a wireline with a transferring/recording/receiving device may be lowered downhole. The wireline may be lowered through use of gravity, or in certain embodiments, through use of tractor devices, which are known in the art. When downhole, the transferring/recording/receiving device may initiate wireless communication with automatic packer 100. Data may thus be transferred to/from automatic packer 100, thereby allowing data to be sent to the surface and/or actuation signals to be sent from the surface to automatic packer 100. In certain embodiments, automatic packer 100 may be reprogrammed through use of such a system.

In certain embodiments, sensors 115 may also include gyroscopes and relative closeness indicators. Relative closeness indicators, such as transmitters/receivers to measure the closeness of automatic packer 100 to a well bore wall may be used to determine a position of automatic packer 100 within the well.

Automatic packer 100 may further include a power source (not independently shown) connected to one or more of sensors 115 and/or data controller 120. The type of power source used may vary according to the requirements of the operation, however, in certain embodiments one or more lithium ion batteries may be used to power sensors, data controller, or other devices disposed on automatic packer 100. In certain embodiments, the power source may include a recharging battery system that is capable of being recharged either downhole, at the surface, or from the surface using wired connections.

In certain embodiments, automatic packer 100 may also include a wireless transmitter (not independently shown). The wireless transmitter may, in certain embodiments, be included as a component on data controller 120, or may be a standalone device within tool body 105. The wireless transmitter may be used to send data measured by sensors 115 to the surface of the well. The wireless transmitter may also be used to communicate the position or status of automatic packer 100 to the surface of the well. In certain embodiments, the wireless transmitter may be used to inform an operator of a wellbore whether automatic packer 100 has been actuated, and if so, the location of automatic packer 100 within the well.

In still other embodiments, automatic packer 100 may include a tractor or mobile deployment system capable of moving the automatic packer 100 into a desired position within the well. Those of ordinary skill in the art will appreciate that tractors and other mobile deployment systems are known in the art and may be used to pull or push automatic packer to a desired location within a well prior to actuation of automatic packer 100. Such systems may be of particular use in highly deviated wells, or wells in which gravity alone may not carry automatic packer 100 to the desired deployment location.

Figure 2:
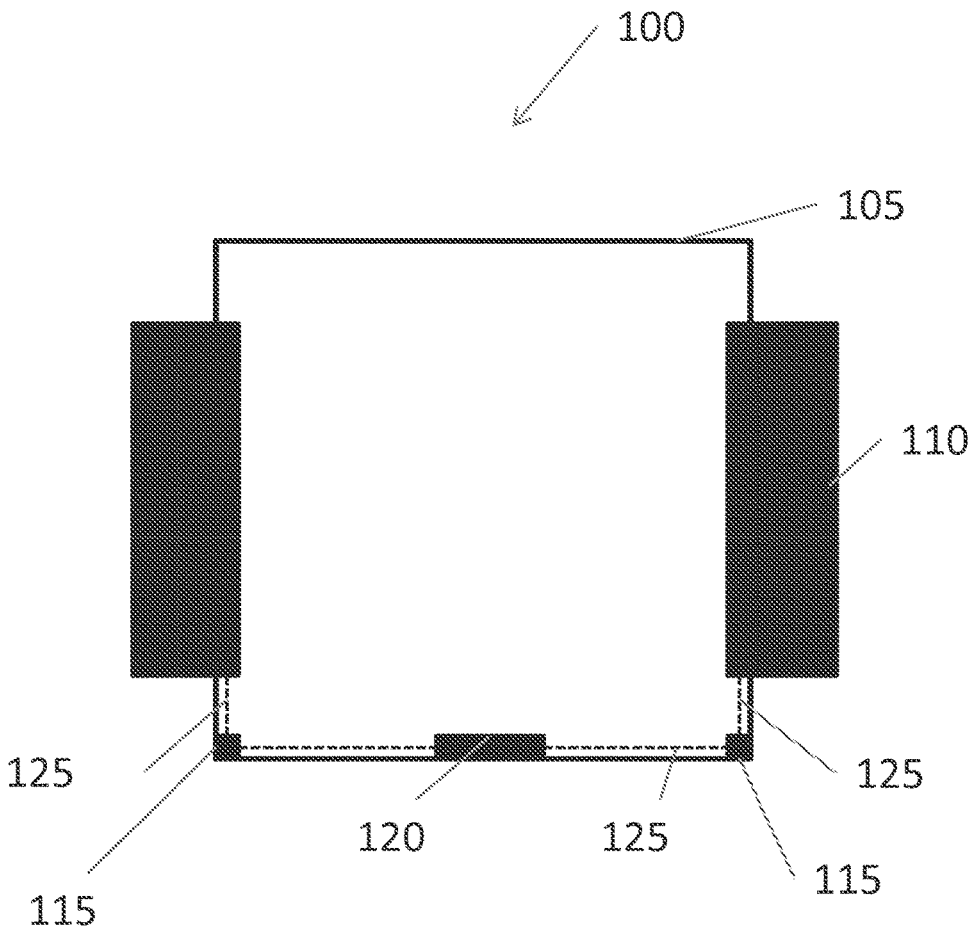
FIG. 2 is a cross-sectional view of an automatic packer according to embodiments of the present disclosure.

Referring to FIG. 2, a cross-sectional view of an automatic packer 100 in an actuated condition according to embodiments of the present disclosure is shown. As explained above with respect to FIG. 1, automatic packer 100 includes a tool body 105, a sealing element 110, at least one sensor 115, a data controller 120, and wiring 125 connecting the at least one sensor 115 to the data controller 120 and the sealing element 110.

In operation, automatic packer 100 is disposed within a well and falls within the well to a certain position. While automatic packer 100 falls within the well, sensors 115 measure and/or records conditions within the well. As described above, examples of conditions that sensors may measure include a temperature, a pressure, a fluid type, specific gravity spinner, induction, conduction, refraction, infrared, a load, an acceleration, a velocity, a fiber optic signal, an ultrasonic signal, a tachometer measurement, a wireless transmission, a gyroscopic measurement, a casing collar locator, a modular reservoir dynamic test, and/or a position within the well. When the automatic packer reaches a desired location within the well, automatic packer 100 may be actuated, thereby causing sealing element 110 to engage an inner diameter of the well. In certain embodiments, the inner diameter of the well may be a section of casing (not shown), while in other embodiments, such as an uncased well, the sealing element 110 may engage and inner diameter of a wellbore wall.

Various types of packers that are known in the art may be used with embodiments of the present disclosure. Examples of such packers may include composite, drillable, permanent and retrievable packers. The packers may be hydraulically set, differentially set, mechanically set, tension set, compression set, etc. Additionally, both small and large bore packers may be actuated using the methods described herein.

Additional methods for automatically actuating automatic packer 100 are discussed in detail below. Prior to discussing the actuation of automatic packer in detail, additional components that may be used according to embodiments of the present disclosure are discussed.

Figure 3:
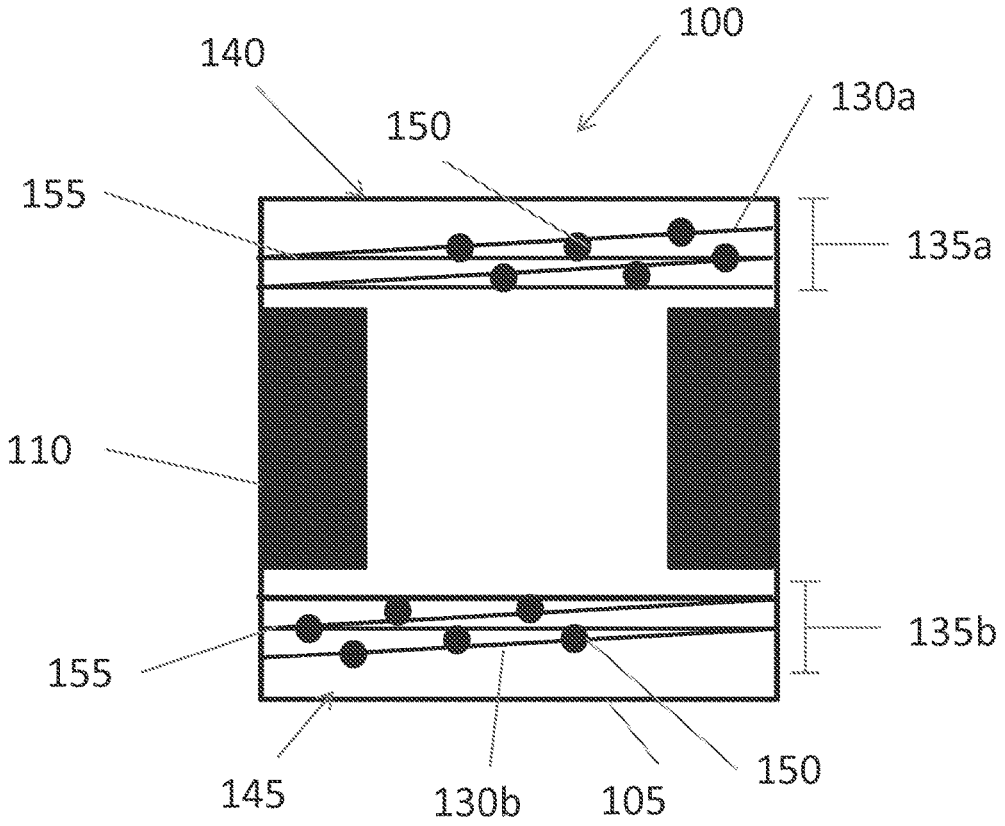
FIG. 3 is a cross-sectional view of an automatic packer according to embodiments of the present disclosure.

Referring to FIG. 3, a cross-sectional view of an automatic packer 100 having an extendable perforator 130 according to embodiments of the present disclosure is shown. In this embodiment, automatic packer 100 includes a tool body 105, a sealing element 110, and sensors (not shown), and may also include various other devices, such as a data controller (not shown), a wireless transmitter (not shown), wiring (not shown), etc.

In FIG. 3, automatic packer 100 is shown in an unexpanded or unactuated condition, such that sealing element 110 is not radially expanded. Automatic packer 100 also includes two perforator partitions 135, a first perforator partition 135*a* disposed at a top portion 140 of automatic packer 100 and a second perforator partition 135*b* disposed at a bottom portion 145 of automatic packer 100. First and second perforator partitions 135*a*/135*b* may be used to store one or more extendable perforators 130. As illustrated, automatic packer 100 includes a first extendable perforator 130*a* stored in first perforator partition 135*a* and a second extendable perforator 130*b* stored in second perforator partition 135*b*. The extendable perforators 130*a*/130*b* each include a plurality of perforator charges 150. Those of ordinary skill in the art will appreciate that the number of charges may vary based on the requirements of the operation. For example, extendable perforators 130*a*/130*b* may include one charge, or may include tens of charges depending on the area being perforated.

Perforation charges 150 include an explosive device that uses a cavity-effect explosive reaction to generate a high-pressure, high-velocity jet that creates a perforation tunnel in formation. The shape of the explosives and container determine the shape of the jet and the performance characteristics of the perforation charge 150. The perforation tunnel in the formation is caused by the high pressure and velocity of the jet, and causes materials, such as steel, cement, and rock to flow plastically around the jet path, thereby causing the tunnels to form.

Perforation charges 150 are disposed on wire 155 that is used to form extendable perforators 130*a*-130*b*. The wire 155 may be any type of wiring that may be used to hold and actuate perforation charges 150. For example, in certain embodiments, wire 155 may include a hollow section to allow additional wiring (not shown), to be run along extendable perforators 130*a*/130*b*, thereby allowing a detonation signal to be sent from automatic packer 100. In other embodiments, wire 155 may be able to carry a detonation signal directly from automatic packer 100 to perforation charges 150.

Figure 4:
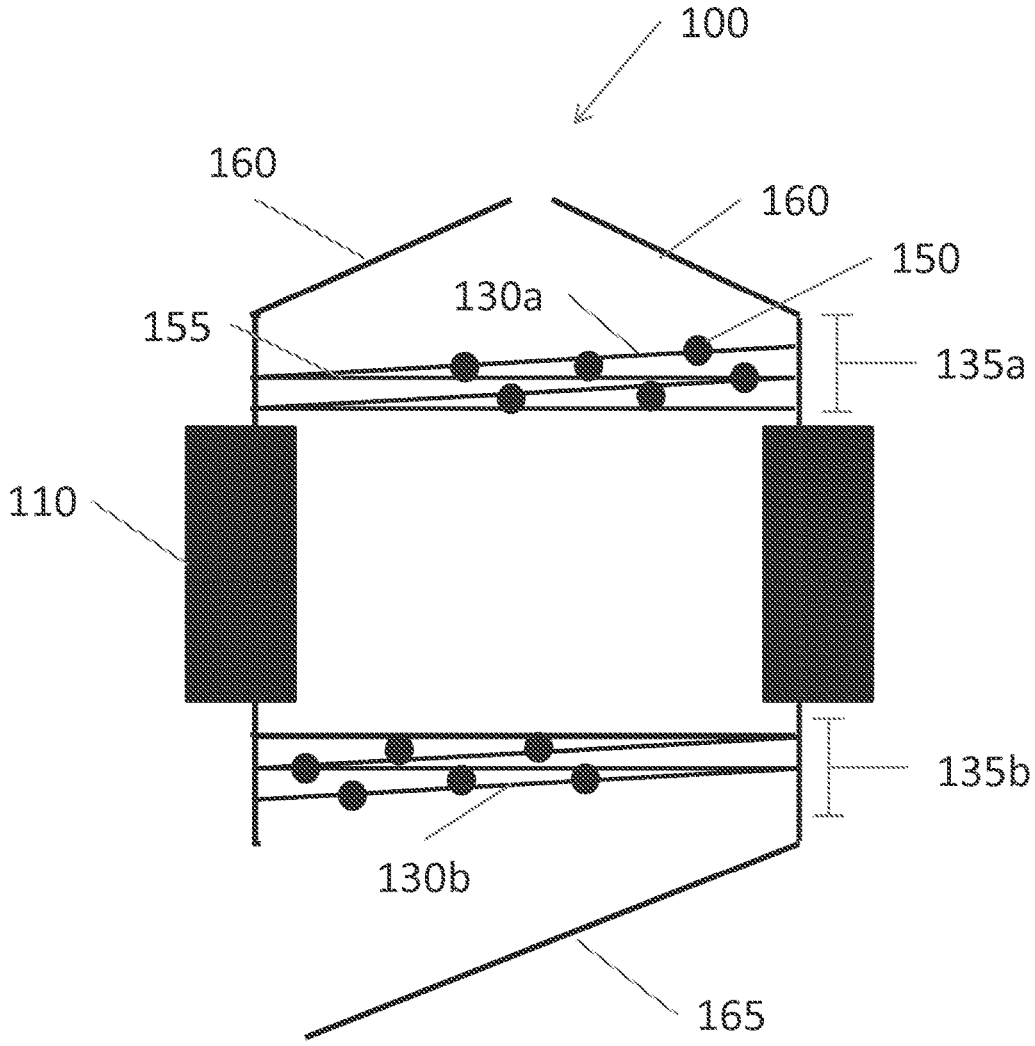
FIG. 4 is a cross-sectional view of an automatic packer according to embodiments of the present disclosure.

Referring to FIG. 4, a cross-sectional view of the automatic packer 100 of FIG. 3 in an actuated condition according to embodiments of the present disclosure is shown. In this embodiment, automatic packer 100 includes a tool body 105, a sealing element 110, and sensors (not shown), and may also include various other devices, such as a data controller (not shown), a wireless transmitter (not shown), wiring (not shown), etc. Automatic packer 100 also includes two extendable perforators 130*a*/130*b* disposed on first and second perforator partitions 135*a*/130*b*, respectively. extendable perforators 130*a*/130*b* include a plurality of perforation charges 150 disposed on wire 155.

As discussed briefly above, when automatic packer 100 is disposed in a well, automatic packer 100 travels down the well until it reaches a desired position. When the position is determined by the sensors (not shown), automatic packer 100 actuates, thereby causing sealing elements 110 to radially expand into contact with the inner diameter of the well (not shown). By radially expanding sealing elements 110, the well (not shown) is divided into two portions, a top portion that extends above automatic packer 100 to the surface (not shown), and a bottom portion that extends below automatic packer 100 to the bottom of the well (not shown).

FIG. 4 illustrates two different methods for extending extendable perforators 130*a*/130*b*. Top perforator partition 135*a* includes two hinged doors 160, which upon actuation, open outwardly, thereby allowing extendable perforator 130*a* to extend axially upward within the well. Bottom perforator partition 135*b* includes a single hinged door 165, which upon actuation, opens outwardly, thereby allowing extendable perforator 130*b* to extend axially downward within the well. As explained above, doors 160 and 165 may be hinged, thereby allowing doors 160 and 165 to remain attached to automatic packer 100.

In other embodiments, actuation of automatic packer 100 may cause the doors 160 and 165 to blast outwardly from automatic packer 100, thereby allowing extendable perforators 130*a*/130*b* to be released from top and bottom perforator partitions 135*a*/135*b*, respectively. In still other embodiments, any other type of device may be used to hold extendable perforators 130*a*/130*b* with automatic packer 100. For example, collapsible or radially retractable doors may be used, as well as telescoping doors. In still other embodiments, automatic packer 100 may not include doors, and rather include retention devices that hold extendable perforators 130*a*/130*b* within top and bottom perforator partitions 135*a*/135*b*, respectively. In such an embodiment, the top and bottom perforator partitions 135*a*/135*b* would not be isolated from the well environment during actuation. In certain embodiments, top and bottom perforator partitions 135*a*/135*b* may be isolated from one another through use of a valve (not shown) disposed between the two partitions. The valve may be controlled through use of a data controller or PLC (not shown) that may be manipulated in order to control top and bottom perforator partitions 135*a*-135*b*.

In still other embodiments, the doors 160/165 may dislodge from the automatic packer 100 as part of the extendable perforators 130*a*/130*b*. In such an embodiment, doors 160/165 may form a parachute that acts as a brake or drag device to hold extendable perforators 130*a*/130*b* in tension. Dislodged doors 160/165 may also be used to slow down automatic packers 100 decent within the well in order to put automatic packer 100 into position prior to actuation. In other embodiments, extendable perforators 130*a*/10*b* may be released through use of a pump out plug or rupture of a rupture disk, such as a disk made from glass or ceramic that is configured to rupture upon application of a specific pressure.

Figure 5:
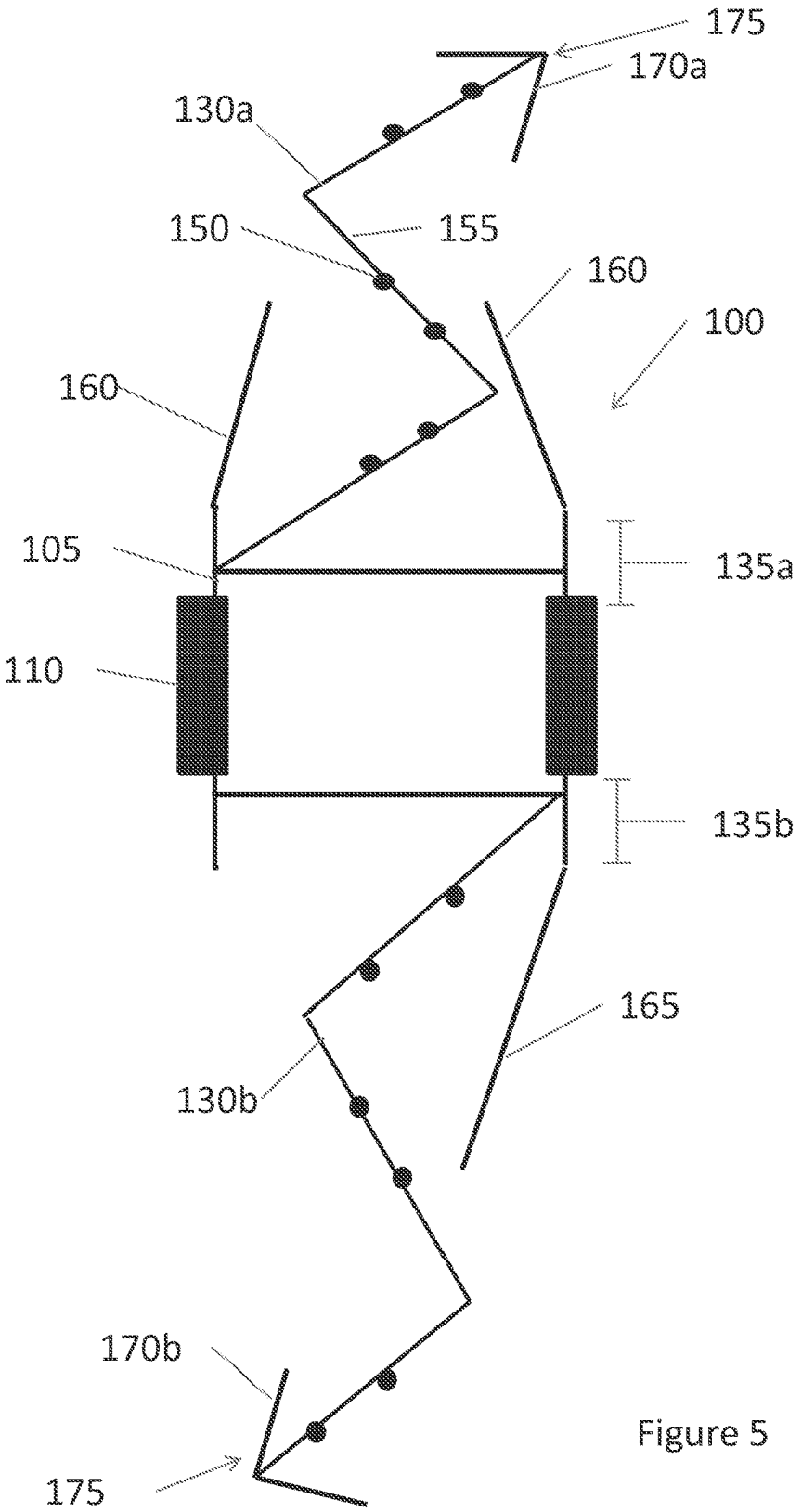
FIG. 5 is a cross-sectional view of an automatic packer according to embodiments of the present disclosure.

Referring to FIG. 5, a cross-sectional view of automatic packer 100 of FIGS. 3 and 4 according to embodiments of the present disclosure is shown. In this embodiment, automatic packer 100 includes a tool body 105, a sealing element 110, and sensors (not shown), and may also include various other devices, such as a data controller (not shown), a wireless transmitter (not shown), wiring (not shown), etc. Automatic packer 100 also includes two extendable perforators 130*a*/130*b* disposed on first and second perforator partitions 135*a*/135*b*, respectively. Extendable perforators 130*a*/130*b* include a plurality of perforation charges 150 disposed on wire 155.

In FIG. 5, extendable perforators 130*a*/130*b* are shown expanding longitudinally upward and downward, respectively. As illustrated, the wire 155 expands upwardly and downwardly, thereby separating the charges longitudinally within the well (not shown). In order to ensure extendable perforators 130*a*/130*b* expand longitudinally fully within the well (not shown), a well retention device 170*a*/170*b* may be disposed at a terminal end 175 of extendable perforators 130*a*/130*b*, respectively. Well retention device 170*a*/170*b* may include a radially projection that is configured to engage the inner diameter of the well, whether the well is cased or uncased.

Depending on the type of well, well retention device 170*a*/170*b* may include a plurality of externally projecting teeth (not independently illustrated), which may be formed from, for example, steel or tungsten carbide. Additionally, well retention device 170*a*/170*b* may include hardfacing, such as tungsten carbide hardfacing that allows well retention device 170*a*/170*b* to grip the inner diameter of the well (not shown). Those of ordinary skill in the art will appreciate that examples of well retention devices 170 may include dog slips, such as those used with other downhole tools. Specifically aspects of well retention device 170*a*/170*b* will be discussed in detail with respect to FIGS. 6-9, below.

Those of ordinary skill in the art will appreciate that while automatic packer 100 has been illustrated and discussed as having two extendable perforators 130*a*/130*b*, in certain embodiments, automatic packer 100 may only have a single extendable perforator 130. For example, in certain embodiments, it may only be necessary to perforate an area above or below the automatic packer 100. In such an embodiment, only a single extendable perforator 130 may be used.

Figure 6:
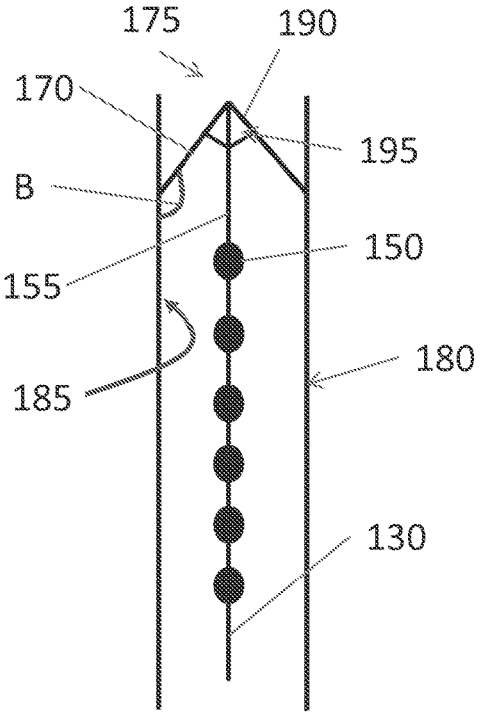
FIG. 6 is a cross-sectional view of an extendable perforator according to embodiments of the present disclosure.

Referring to FIG. 6, a cross-sectional view of an extendable perforator 130 disposed within a well 180 according to embodiments of the present disclosure is shown. In this embodiment, only the extendable perforator 130 of automatic packer (not shown) is illustrated disposed within a well 180. The well 180 has an inner diameter well wall 185, which defines the diameter of the well. Depending on the operation, the well wall 185 may be cased or uncased. In the operation of a cased well wall, the well wall may be formed from metal and/or metal allow tubulars cemented into place within the wellbore (not independently illustrated). In the case of an uncased wellbore, the well wall 185 may be formed from rock formation.

As illustrated, extendable perforator 130 is illustrated longitudinally within well 175. By longitudinally expanding extendable perforator 130, perforation charges 150 may be disposed at a desired position within well 180. Those of ordinary skill in the art will appreciate that the orientation and spacing of perforation charges 150 may vary depending on the desired perforation effect upon detonation. For example, perforation charges 150 may be spaced in increments of inches, feet, or tens of feet, and wire 155 may space charges for several feet, tens or feet, or in certain occasions hundreds of feet longitudinally within the well 180. Additionally, perforation charges 150 may be oriented, or angled on wire 155, thereby allowing the charges to create tunnels into the formation at a desired orientation.

In order to hold extendable perforator 130 in an expanded condition within well 175, a well retention device 170 may be disposed on a terminal end 175 of extendable perforator 130. The well retention device 170 may include a plurality of projections (not shown) that are configured to engage the inner diameter of well wall 185. As explained above, the plurality of projections may include teeth or an applied material that allows the well retention device to engage or grip into well wall 185.

When extendable perforator 130 is stored in an extendable partition (not shown) of automatic packer (not shown), well retention device 170 may be in a closed position, such that arms 190 of well retention device 170 are collapsed. However, open release of extendable perforator 130 from the extendable partition (not shown) of automatic packer (not shown), the arms 190 may radially extend outwardly into engagement with well wall 185.

In certain embodiments, arms 190 of well retention device 170 may be biased in an open position through use of a spring 195. While extendable perforator 130 is stored within automatic packer (not shown), spring 195 may be compressed, and arms 190 may be unexpanded. When extendable perforator 130 is released from automatic packer (now shown), spring 195 may force arms radially outward until the arms 190 engage the well wall 185. After arms 190 are radially expanded and into contact with well walls 185, the wire 155 may be held taut within the well 180, thereby holding extendable perforator 130 in a longitudinally expanded condition. In certain embodiments, one or more springs (not shown) may be used to keep the wire 155 in tension. In still other embodiments, one or more springs (not shown) may be used so that a portion of the wire 155 may be reeled back in, in order to keep wire 155 stretched outwardly. In certain embodiments, wire 155 may be extended into the well through use of an explosive, detonation, or rapid force release, which may be either hydraulic or pneumatic. For example, in one embodiment, a pressurized gas may be released, thereby providing outward thrust.

Figure 7:
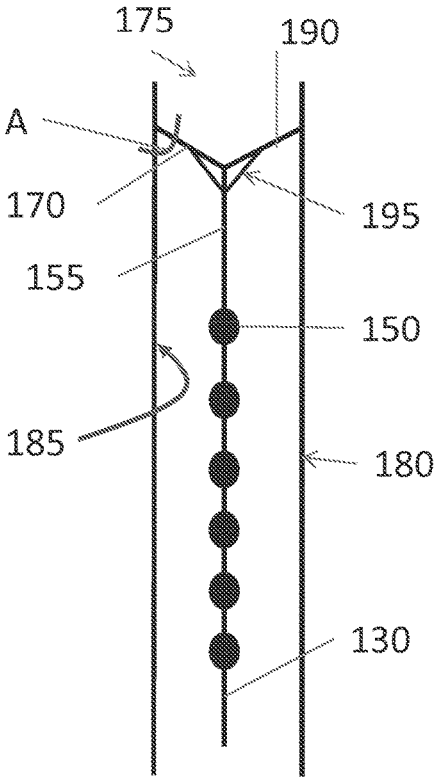
FIG. 7 is a cross-sectional view of an extendable perforator according to embodiments of the present disclosure.

Referring also to FIG. 7, a cross-sectional view of an extendable perforator 130 disposed within a well 180 according to embodiments of the present disclosure is shown. In this embodiment, only the extendable perforator 130 of automatic packer (not shown) is illustrated disposed within a well 180. The well 180 has an inner diameter well wall 185, which defines the diameter of the well. Depending on the operation, the well wall 185 may be cased or uncased.

As illustrated, extendable perforator 130 is illustrated longitudinally within well 180. By longitudinally expanding extendable perforator 130, perforation charges 150 may be disposed at a desired position within well 180. In order to hold extendable perforator 130 in an expanded condition within well 180, a well retention device 170 may be disposed on a terminal end 175 of extendable perforator 130. The well retention device 170 may include a plurality of projections (not shown) that are configured to engage the inner diameter of well wall 185. As explained above, the plurality of projections may include teeth or an applied material that allows the well retention device to engage or grip into well wall 185.

When extendable perforator 130 is stored in an extendable partition (not shown) of automatic packer (not shown), well retention device 170 may be in a closed position, such that arms 190 of well retention device 170 are collapsed. However, open release of extendable perforator 130 from the extendable partition (not shown) of automatic packer (not shown), the arms 190 may radially extend outwardly into engagement with well wall 185. In order to hold arms 190 in a biased open position, once released from automatic packer (not shown), one or more springs 195 may be disposed in contact with arms 190.

In FIG. 7, as opposed to FIG. 6, arms 190 are shown expanding into contact with well wall 185, such that retention angle $\alpha$ formed between well wall 185 and arm 190 is less than 90°. In such an embodiment, arms 190 move along well wall 185 until they engage well wall 185, pulling wire 155 taut and thereby substantially longitudinally expanding extendable perforator 130. Referring back to FIG. 7, arms are shown expanding into contact with well wall 185, such that retention angle β formed between well wall 185 and arm 190 is greater than 90°. In such a position, wire 155 is also allowed to longitudinally expand, thereby holding extendable perforator 130 in a substantially expanded condition.

Figure 8:
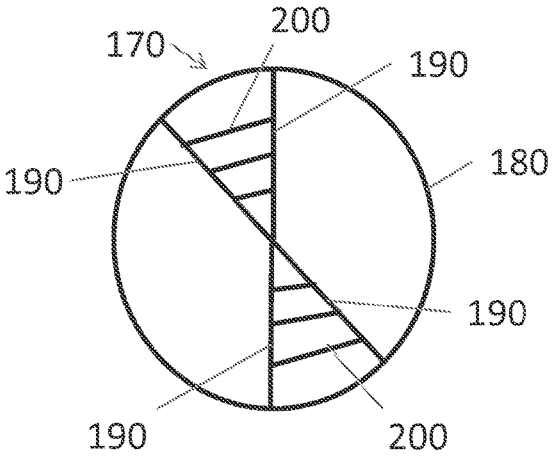
FIG. 8 is a top cross-sectional view of an extendable perforator according to embodiments of the present disclosure.
Figure 9:
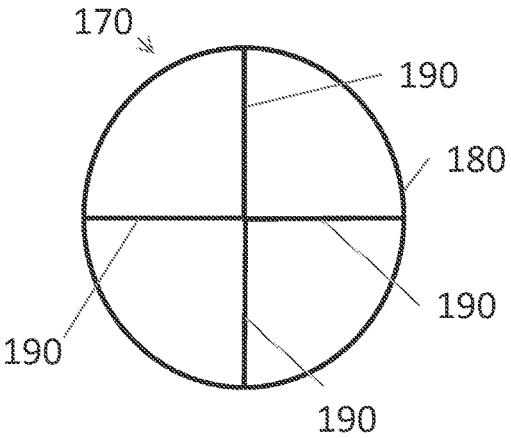
FIG. 9 is a top cross-sectional view of an extendable perforator according to embodiments of the present disclosure.

Referring to FIGS. 8 and 9, top cross-sectional views of well retention devices 170 within a well 180 according to embodiments of the present disclosure are shown. Referring specifically to FIG. 7, in this embodiment, well retention device 170 is shown having a plurality of arms 190. The plurality of arms 190 include solid portions 200 that is illustrated radially expanded. In certain embodiments, plurality of arms 190 may also have small perforations drilled or otherwise formed thereon that are configured to reduce drag forces acting thereon. The plurality of arms 190 may also have small perforation drilled or otherwise formed therein to reduce drag forces acting thereon. The solid portion 200 may be formed from, for example, various metals, metal alloys, polymers and/or composites. During actuation, well retention device 170 is released from automatic packer (not shown). The arms 190 extend radially outward into engagement with the well 180. In order to increase the speed of deployment, and to facilitate moving extendable perforator (not independently show) within the well 180, solids portions 200 may expand, thereby trapping fluid within the well 180. The trapped fluid pressing against solid portions 200 may thus help pull the extendable perforator within the well 180, facilitating the expansion of extendable perforator. In certain embodiments, solid portion 200 may resemble a parachute or wings that extend in order to allow substantially full expansion.

Depending on the requirements of the operation, the area of the well 180 that is covered by the solid portions 200 may vary. For example, in certain embodiments, the solid portion 200 may cover less than 10% of the cross-sectional well area. In other embodiments, the area covered by the solid portion 200 may range between 10% and 20%, between 20% and 30%, between 30% and 40%, between 40% and 50%, or greater than 50% of the cross-sectional well area. In still other embodiments, the solid portion 200 may cover less than 10% of the cross-sectional well area. In certain embodiments, solid portion 200 may include perforated holes (not shown) or with open slots (not shown) that may be sized in order to change drag resistance and setting speed of solid portion 200. For example, in certain embodiments, the perforated holes may be adjustable, thereby allowing an operator to adjust the diameter of the slot, thereby changing the effect of drag on solid portion 200. In certain embodiments, solid portion 200 may have one or more wings (not independently illustrated). For example, solid portion 200 may include two, three, four, or more wings. In certain embodiments, solid portion 200 may include a concave or convex geometry. Further still, solids portion 200 may include a geometry that is specifically shaped to change the effect of drag or specific setting parameters on solid portion 200. For example, the geometry may be modified to increase a setting speed, slow a setting speed, provide a specific level of expansion, etc.

Depending on the requirements of the operation, the number of arms 190 may also vary. For example, as shown in FIG. 9, well retention device 170 includes four arms, however, in other embodiments two arms, three arms, five arms, or more than five arms may be used. Similarly, the number of solid portions 200 may also vary according to the requirements of the operation. As illustrated, well retention device 170 includes two solid portions 200. However, in alternative embodiments, one solid portion 200, three solid portions 200, four solid portions 200, or greater than four solid portions 200 may be used. Those or ordinary skill in the art will appreciate that the number and area of solid portions 200 may affect the deployment speed of the extendable perforator. Thus, the number and area of solid portions 200 may vary according to the density of the fluid within the well 180, the well pressure, well temperature, types of chemicals being used, and the like.

Figure 10:
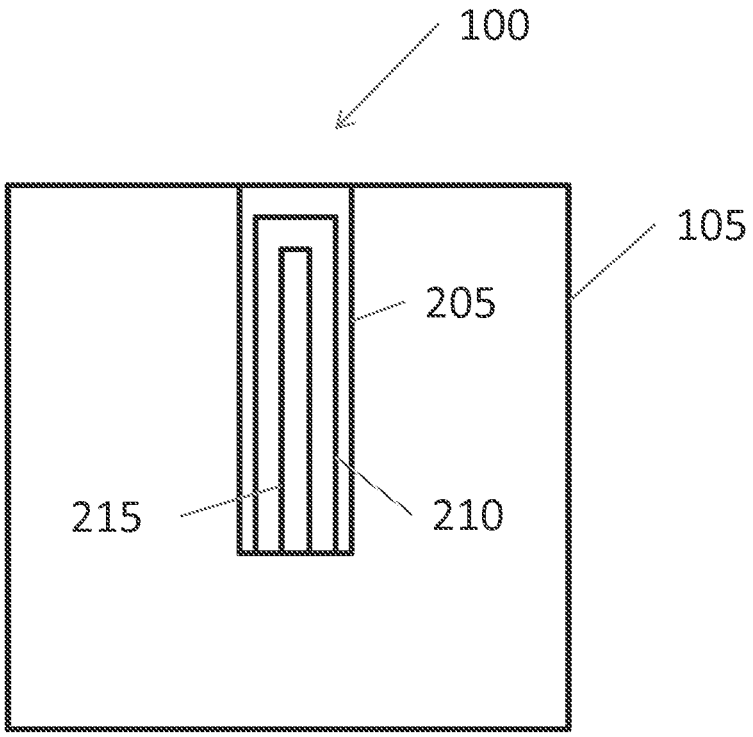
FIG. 10 is a cross-sectional view of an automatic packer according to embodiments of the present disclosure.

Referring to FIG. 10, a cross-sectional view of an automatic packer 100 according to embodiments of the present disclosure is shown. In this embodiment, automatic packer 100 is shown without reference to specific packing elements, such as sealing elements, sensors, and the like. Rather, automatic packer 100 is shown with a telescoping extendable perforator 130.

Figure 11:
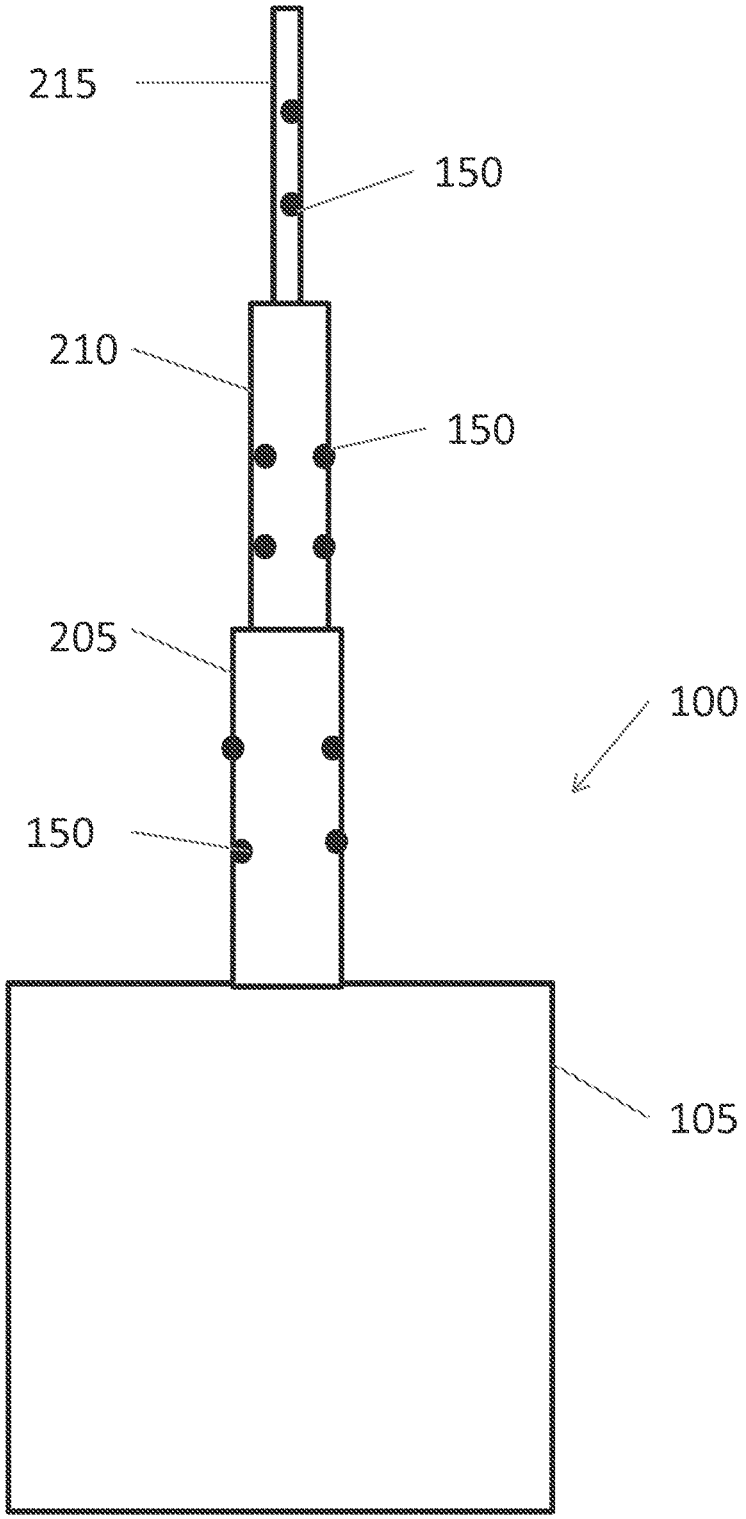
FIG. 11 is a cross-sectional view of an automatic packer according to embodiments of the present disclosure.

Automatic packer 100 includes a tool body 105 and a telescoping extendable perforator 130. In the closed, unactuated position, as illustrated in FIG. 11, the telescoping extendable perforator 130 is illustrated collapsed within the tool body 105 of automatic packer 100. Telescoping extendable perforator 130 is illustrated having three telescopic portions, an outer portion 205, a middle portion 210, and a terminal portion 215. While, telescoping extendable perforator 130 is illustrated having three telescopic portions, those of ordinary skill in the art will appreciate that less than three portions, or more than three portions may be used, depending on the length of area to be perforated and the number of perforation charges (not illustrated) that are required.

Referring to FIG. 11, a side view of an automatic packer 100 in an actuated condition according to embodiments of the present disclosure is shown. In this embodiment, as with FIG. 10, automatic packer 100 is shown without reference to specific packing elements, such as sealing elements, sensors, and the like. Rather, automatic packer 100 is shown with a telescoping extendable perforator 130.

As illustrated, telescoping extendable perforator 130 has expanded longitudinally, thereby axially projecting outer portion 205, middle portion 210, and terminal portion 215 upward. Outer portion 205, middle portion 210, and terminal portion 215 may be held in place relative to one another through use of locking shoulders (not shown) that engage upon actuation. Thus, once longitudinally expanded, the outer portion 205, middle portion 210, and terminal portion 215 are locked in place in an expanded condition.

Each portion of telescoping extendable perforator 130 may include a plurality of perforation charges 150. Depending on the requirements of the operation, the number of perforation chargers 150 as well as the spacing of the perforation charges on the telescoping extendable perforator may vary. Those of ordinary skill in the art having benefit of the present disclosure will appreciate that in certain embodiments, multiple telescoping extendable perforators 130 may be used on a single automatic packer 100. For example, more than one telescoping extendable perforator 130 may expand axially upward, one or more telescoping extendable perforators 130 may expand axially downward, and/or one or more telescoping extendable perforators 130 may expand axially both upward and downward within a well. Because the orientation of the telescoping extendable perforators 130 maybe locked into place upon actuation, the orientation of perforation charges 150 may be controlled, thereby allowing for tunnels to be formed in the formation at desired angles and with a desired geometry.

Figure 12:
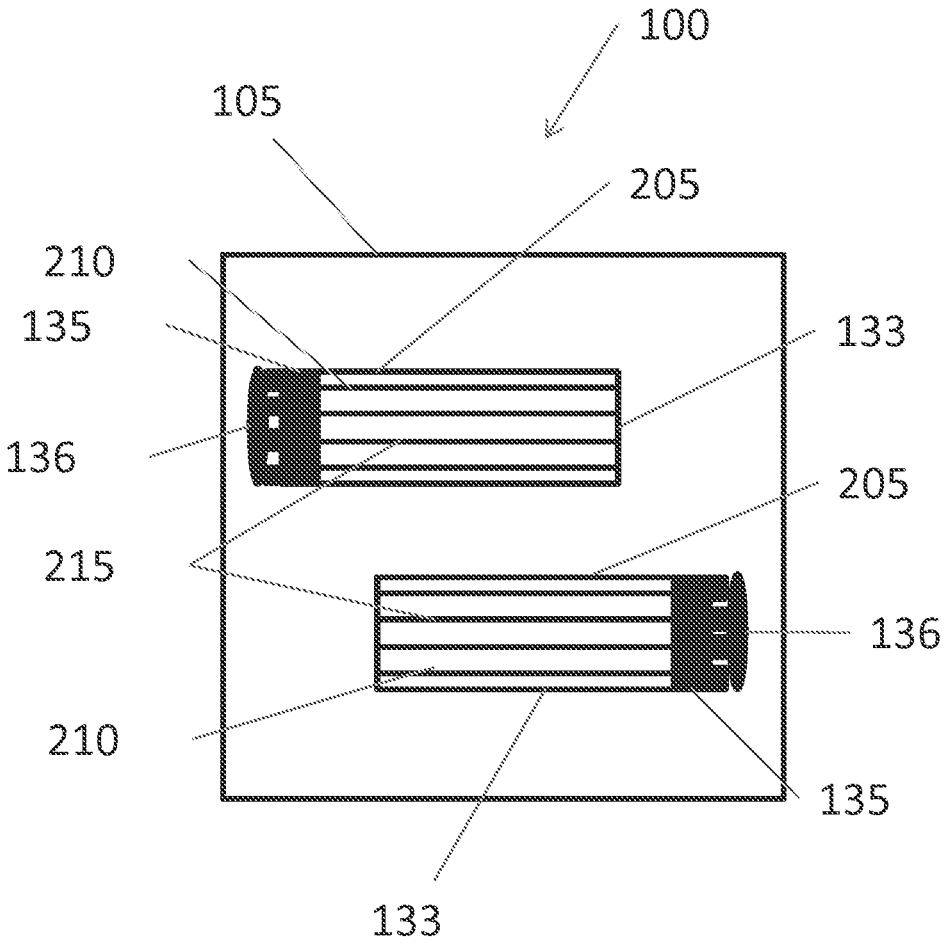
FIG. 12 is a cross-sectional view of an automatic packer according to embodiments of the present disclosure.

Referring to FIG. 12, a cross-sectional view of an automatic packer 100 according to embodiments of the present disclosure is shown. In this embodiment, automatic packer 100 is shown without reference to specific packing elements, such as sealing elements, sensors, and the like. Rather, automatic packer 100 is shown with a latitudinal telescoping extendable drilling mechanism 133.

Automatic packer 100 includes a tool body 105 latitudinal telescoping extendable drilling mechanism 133. In the closed, unactuated position, as illustrated in FIG. 12, the latitudinal telescoping extendable drilling mechanism 133 is illustrated collapsed within the tool body 105 of automatic packer 100. Latitudinal telescoping extendable drilling mechanism 133 is illustrated having three telescopic portions, an outer portion 205, a middle portion 210, and a terminal portion 215. While, latitudinal telescoping extendable drilling mechanism 133 is illustrated having three telescopic portions, those of ordinary skill in the art will appreciate that less than three portions, or more than three portions may be used, depending on the length of area to be perforated and the number of perforation charges (not illustrated) that are required. Additionally, latitudinal telescoping extendable drilling mechanism 133 includes a drill bit 135 and a perforation charge 136. In certain embodiments, extendable drilling mechanism 133 may also be formed from reeled coiled tubing or umbilical card that may be extended or reeled out during drilling. Such tubing may be formed from, for example, various metals, metal alloys, polymers and/or composites.

Figure 13:
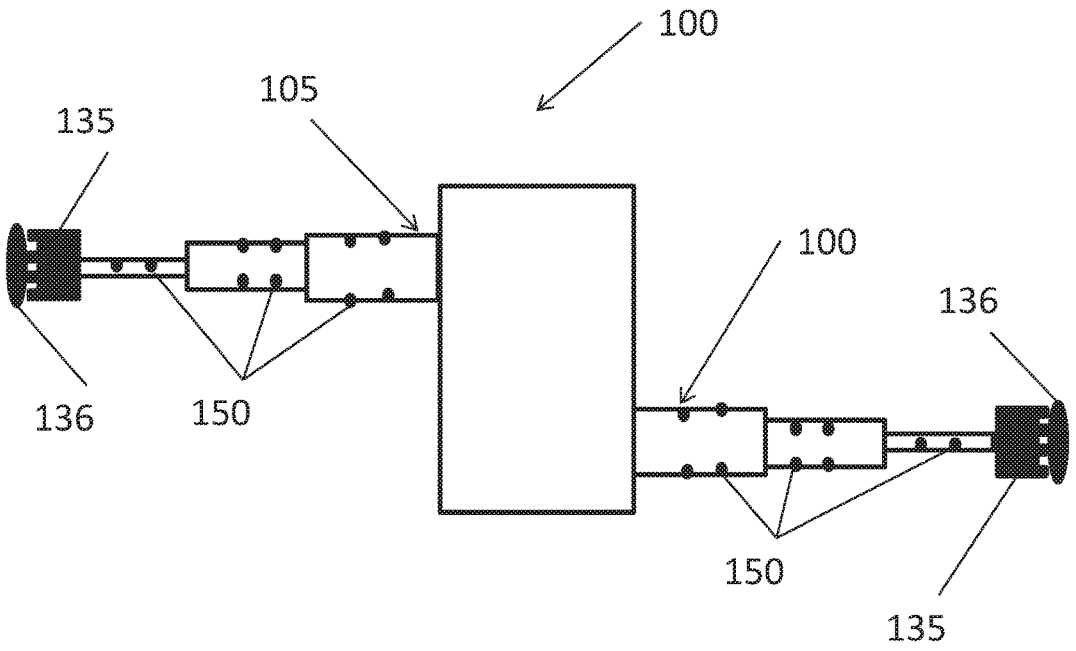
FIG. 13 is a side view of an automatic packer according to embodiments of the present disclosure.

Referring to FIG. 13, a side view of an automatic packer 100 in an actuated condition according to embodiments of the present disclosure is shown. In this embodiment, as with FIG. 10, automatic packer 100 is shown without reference to specific packing elements, such as sealing elements, sensors, and the like. Rather, automatic packer 100 is shown with a latitudinal telescoping extendable drilling mechanism 133. In this embodiment, latitudinal telescoping extendable drilling mechanism 133 includes a drill bit 135 disposed at the end thereof, as well as a perforation charge 136.

During operation, a PLC (not specifically shown) connected to one or more sensors (not specifically shown) may actuate latitudinal telescoping extendable drilling mechanism 133. Upon actuation, latitudinal telescoping extendable drilling mechanism 133 may latitudinally into the well. The perforation charge 136 may thus be detonated in proximity to a location of the well wall or casing that is to be perforated. The drill bit 134 may then be expanded into contact with the casing and one or more holes may be drilled therethrough. In certain embodiments, the drill bit 134 may be configured to continue drilling until the drill bit 134 wears out. In other embodiments, drill bit 134 may be configured to drill to a selected depth within the formation. Drill bit 134 may be actuated pneumatically, electronically, or hydraulically. After the drill bit 134 has drilled into the formation, the telescoping arms may extend therein and the perforation charges 150 may be detonated. Those of ordinary skill in the art will appreciate that each drill bit 134 may be configured to drill one or more holes into the formation. Thus, in certain embodiments, each drill bit 134 may be configured to drill into and thus detonate perforation charges 150 into one drilled hole, while in other embodiments, drill bit 134 may be configured to drill and thus provide perforations to two or more sections of the well.

Figure 14:
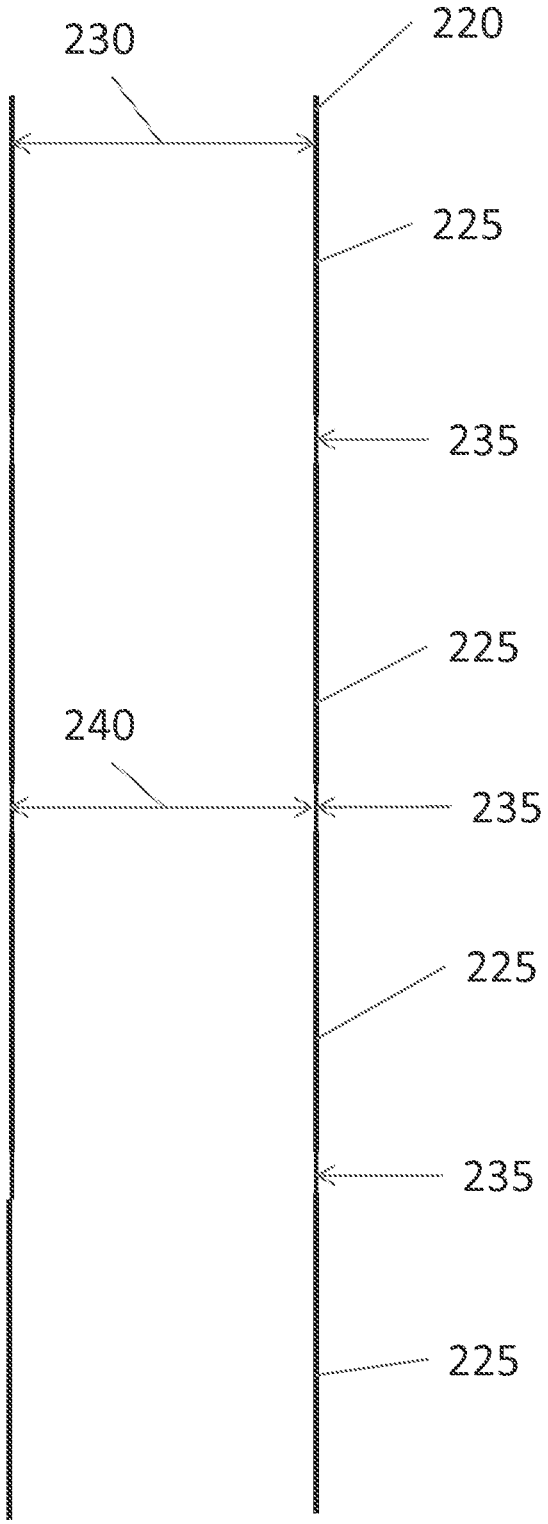
FIG. 14 is a cross-sectional view of a well according to embodiments of the present disclosure.

Referring to FIG. 14, a cross-sectional view of a cased wellbore according to embodiments of the present disclosure is shown. A wellbore 220 that is cased with a plurality of tubulars 225 is illustrated in FIG. 14. During most casing operations, a plurality of tubulars 225 are placed in a wellbore 220, and the plurality of tubulars 225 are then cemented into place. While the tubulars have a known inner diameter 230, the connection point 235, where two tubular sections 225 are jointed together, e.g., coupled, will have a slightly different inner diameter. The inner diameter 240 of tubular connection point 235 is generally slightly larger than the inner diameter 230 of tubular sections 225. For example, in conventional casing the difference between inner diameter 230 of tubular sections 225 and inner diameter 240 of tubular connection point 235 may range between less than about 0.5 mm and about 2.0 mm.

Figure 15:
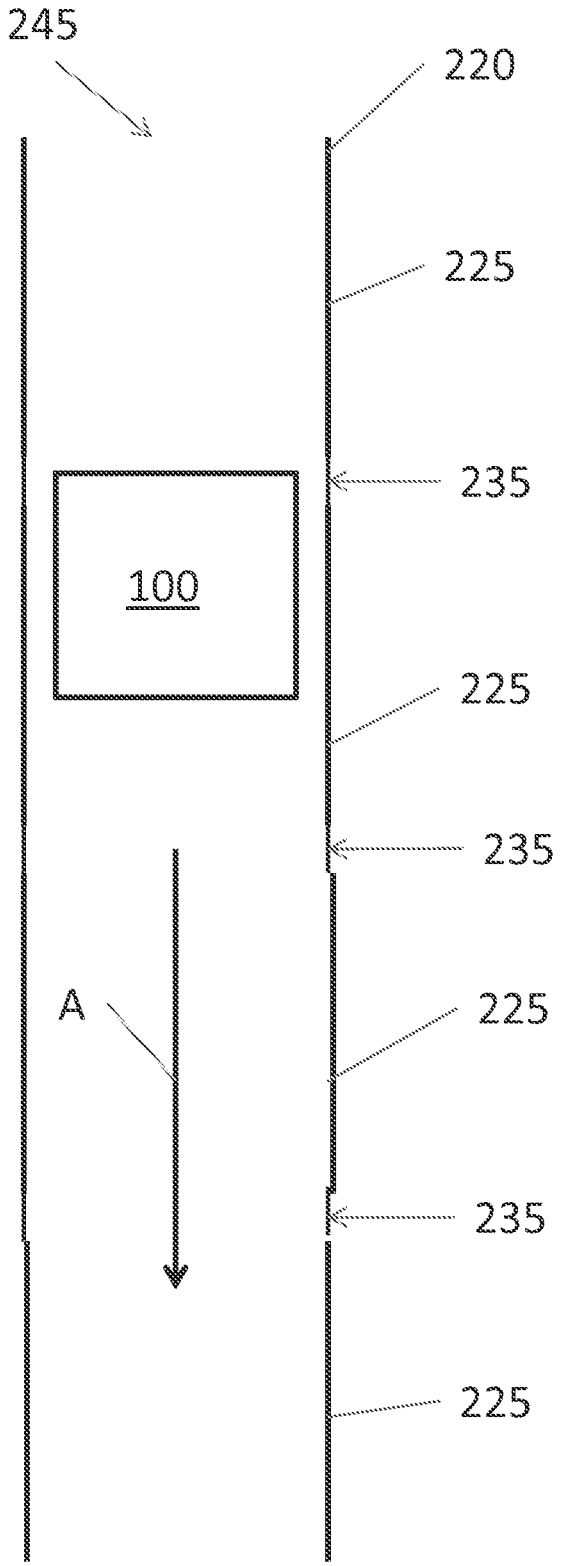
FIG. 15 is a cross-sectional view of an automatic packer in a well according to embodiments of the present disclosure.

Referring to FIG. 15, a cross-sectional view of a well 245 during deployment of an automatic packer 100 according to embodiments of the present disclosure is shown. During deployment, an automatic packer is disposed in a well 245. The automatic packer may include a tool body (not independently referenced), at least one sensor (not shown), at least one sealing element (not shown), as well are various other components, such as those discussed above. Cased well 245 includes a plurality of tubulars 225 that have been cemented into place within the wellbore 220. As explained above, the tubulars 225 have an inner diameter 230, while the tubular connection point 235 has a second slightly larger diameter 240.

As automatic packer 100 moves in direction A within well 245, sensors (not shown), such as calipers or ultrasonic sensors, measure the inner diameter within the well 245. By measure the difference between inner diameter 230 and inner diameter 240, the sensor can calculate the number of tubular sections 225 through which automatic packer 100 has passed. Because the length of tubular sections 225 is known, the depth of automatic packer 100 at any given time can be determined. Other methods to measure a distance or a depth by the sensors may include a casing collar locator, tachometer, temperature, and/or pressure gradient.

Prior to deploying automatic packer 100 in well 245, automatic packer 100 can be configured to deploy at a selected depth. For example, if a production zone is located at 2000 feet, automatic packer 100 may be set to actuation at a desired location below 2000 feet, thereby isolating the production zone from the rest of the well 245. While actuation based on position is discussed in detail herein, those of ordinary skill in the art having the benefit of the present disclosure will appreciate that other preselected parameters may also be used to automatically actuation automatic packer 100. For example, if the pressure at a given location within a well 245 is known, automatic packer 100 may be configured to actuate when a sensor reads the selected pressure. Similarly, if a temperature is known at a location within the well 245, automatic packer 100 may be configured to automatically actuate when the sensors measure the selected temperature. In certain embodiments, if the number of tubular sections within well 245 is known, automatic packer 100 may be configured to automatically actuation when, for example, a casing collar locator sensor measures a depth based on the number of tubular sections.

Figure 16:
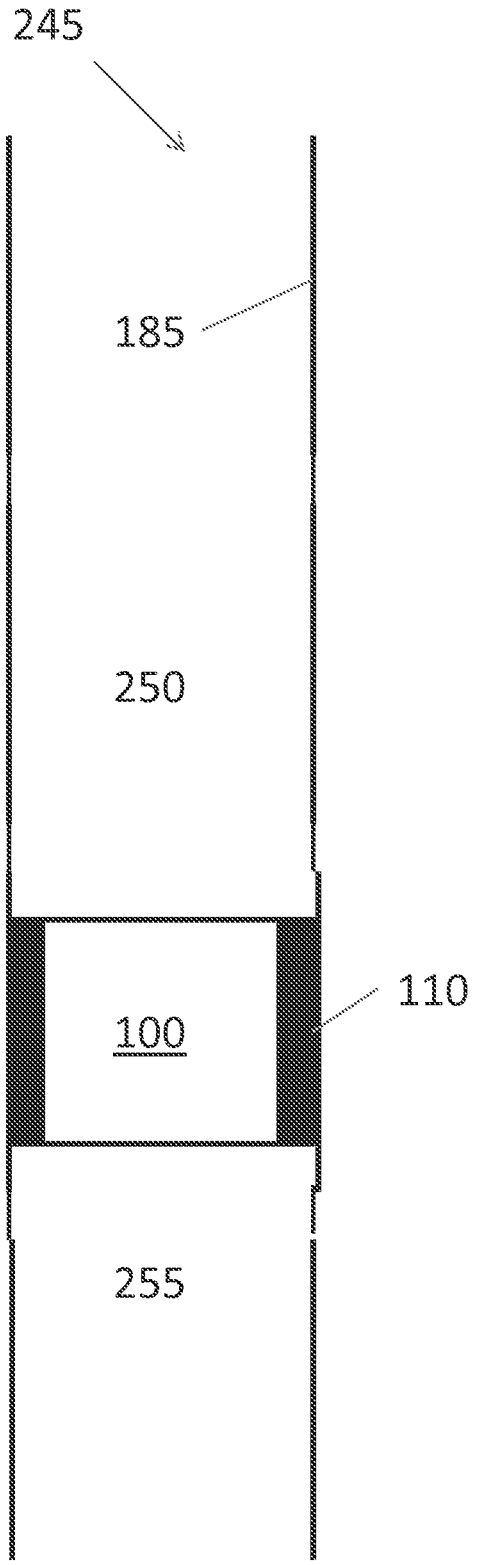
FIG. 16 is a cross-sectional view of an automatic packer in a well according to embodiments of the present disclosure.

Referring to FIG. 16, a cross-sectional view of automatic packer 100 within a well 245 according to embodiments of the present disclosure is shown. As illustrated, automatic packer 100 has passed through a specified depth as preselected by an operator prior to deployment. Upon passing through the preselected depth measured by the sensors (not independently shown), automatic packer 100 actuates, thereby causing sealing elements 110 to radially expand into contact with well wall 185. In certain embodiments, a PLC may determine that the falling velocity of automatic packer 100 is too high. In such a situation, automatic packer 100 may be configured to deploy a small parachute (not shown), such as those described above with respect to the aforementioned solid portion. Alternatively, one or more dog slips (not shown) or other mechanical gripping device may be actuated in order to contact the well wall, such that the drag/friction slows down the decent of automatic packer 100. After actuation, well 245 is divided into a top well partition 250 and a bottom well partition 255.

In certain embodiments, isolation of a section of well 245 may be the entire operation automatic packer 100 is configured to do. In such an embodiment, top well partition 250 and or bottom well partition 255 may be chemically treated, casing may be repairs, offsets may be drilled, or other actions may be performed that requires sectional isolation. However, in certain embodiments, automatic packer may also be capable of performing an automatic perforation, which is discussed below with respect to FIG. 18.

Figure 17:
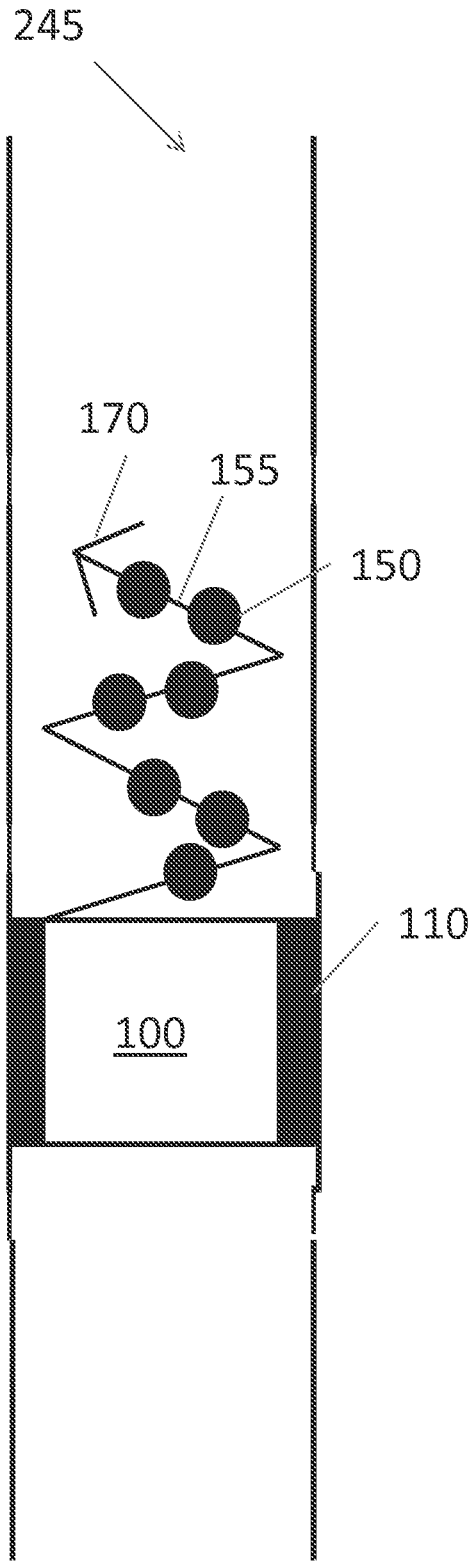
FIG. 17 is a cross-sectional view of an automatic packer in a well according to embodiments of the present disclosure.

Referring to FIG. 17, a cross-sectional view of an automatic packer 100 in a well 245 according to embodiments of the present disclosure is shown. After actuation of automatic packer 100, thereby radially expanding sealing elements 110, a second signal may be sent from sensor (not shown) or data controller (not shown) triggering deployment of extendable perforator 130. As explained above with respect to FIG. 5, extendable perforator 130 may be released from automatic packer 100 and allowed to travel longitudinally upward into well 245.

Extendable perforator 130 includes a wire 155 onto which a plurality of perforation charges 150 are disposed. Extendable perforator 130, in this embodiment, also includes a well retention device 170. As illustrated, extendable perforator 130 may expand longitudinally along the axis of the well 245 prior to detonation of perforation charges 150.

Figure 18:
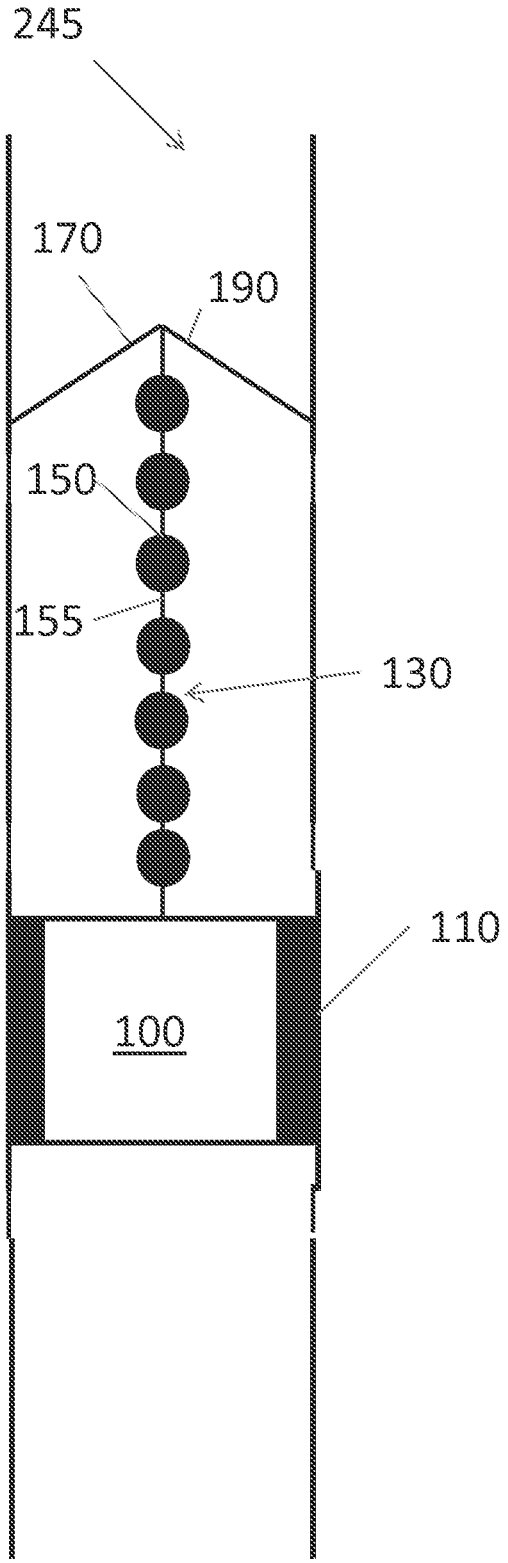
FIG. 18 is a cross-sectional view of an automatic packer in a well according to embodiments of the present disclosure.

Referring to FIG. 18, a cross-sectional view of an automatic packer 100 in a well 245 according to embodiments of the present disclosure is shown. Fluid flow within well 245 pushes extendable perforator 130 longitudinally upward. In certain embodiments, extendable perforator 130 may be pushed upwardly through use of a mechanical thrust activator (not shown). As illustrated, expanded arms 190 of well retention device 170, as well as solid portions (not shown) facilitate the expansion of extendable perforator 130. When wire 155 of extendable perforator 130 is substantially fully extended longitudinally within well 245, the well retention device 170 engages the inner wall of well 245, thereby holding and locking extendable perforator 130 into place. In an expanded position, perforation charges 150 may be spaced within the well 245 as desired by the operator.

After expansion of extendable perforator 130, the perforation charges 150 may be detonated in order to perforate the well 245.

Figure 19:
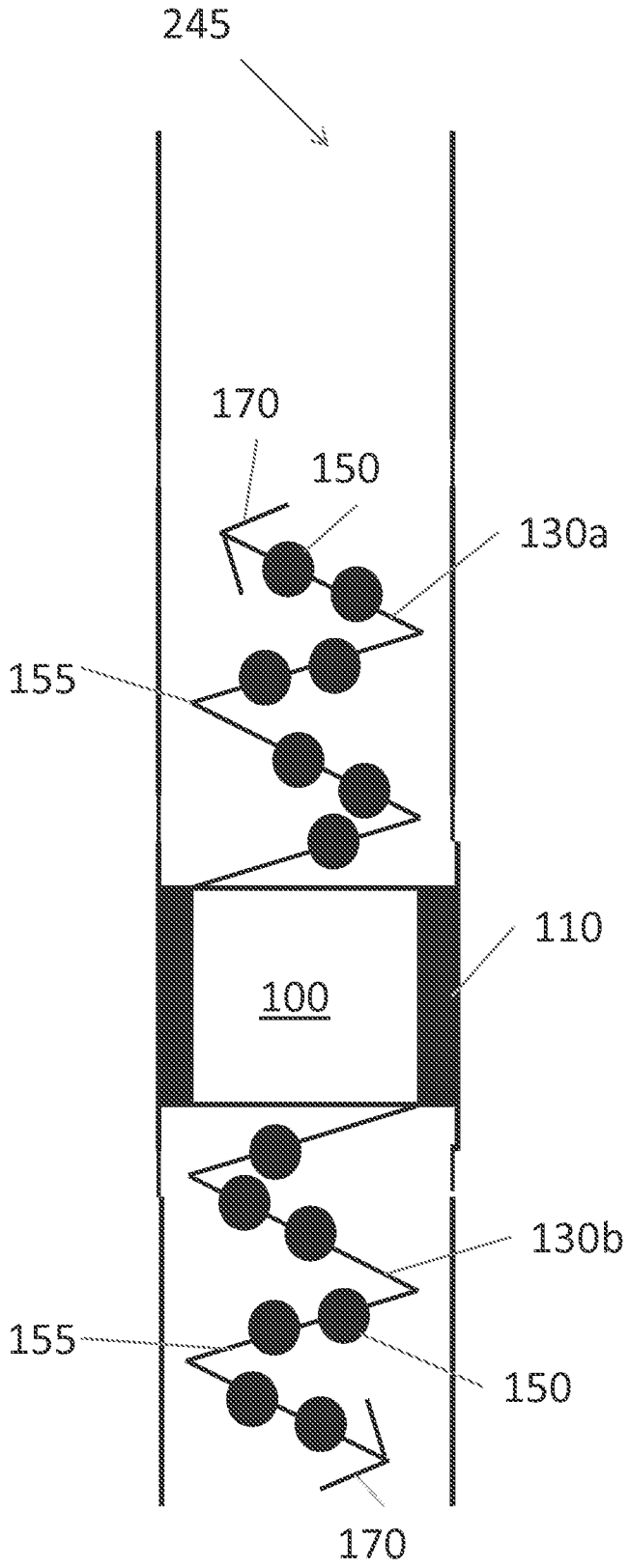
FIG. 19 is a cross-sectional view of an automatic packer in a well according to embodiments of the present disclosure.

Referring to FIG. 19, a cross-sectional view of an automatic packer 100 in a well 245 according to embodiments of the present disclosure is shown. After actuation of automatic packer 100, thereby radially expanding sealing elements 110, a second signal may be sent from sensor (not shown) or data controller (not shown) triggering deployment of extendable perforator 130. As explained above with respect to FIG. 5, extendable perforator 130 may be released from automatic packer 100 and allowed to travel longitudinally upward into well 245.

Each extendable perforator 130 includes a wire 155 onto which a plurality of perforation charges 150 are disposed. Extendable perforators 130, in this embodiment, also include a well retention device 170. As illustrated, extendable perforators 130 may expand longitudinally along the axis of the well 245 prior to detonation of perforation charges 150.

Similar to FIG. 17, the automatic packer 100 of FIG. 19 includes two extendable perforators 130. The top extendable perforator 130*a* is configured to extend longitudinally upward within the well 245, while bottom extendable perforator 130*b* is configured to extend longitudinally downward within the well 245.

Figure 20:
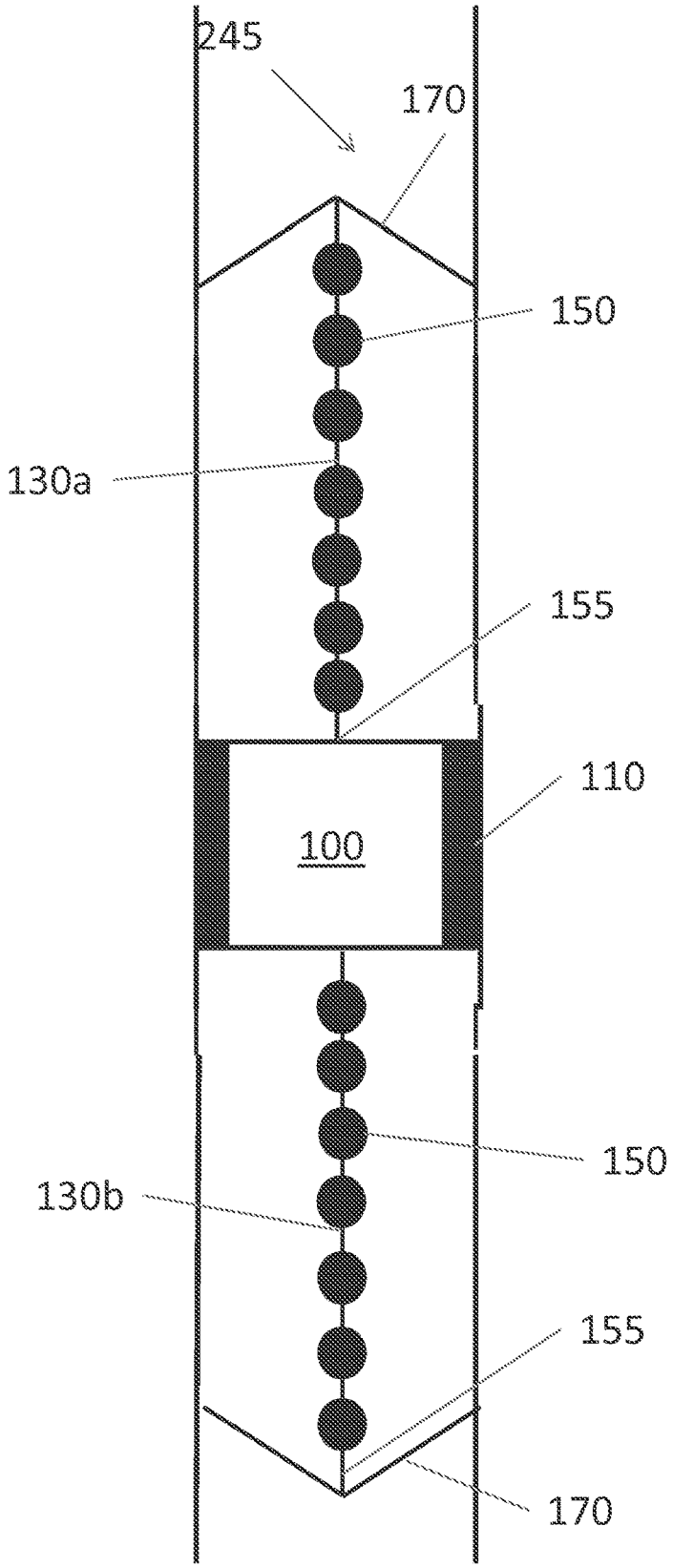
FIG. 20 is a cross-sectional view of an automatic packer in a well according to embodiments of the present disclosure.

Referring to FIG. 20, a cross-sectional view of an automatic packer 100 in a well 245 according to embodiments of the present disclosure is shown. Fluid flow within well 245 pushes extendable perforator 130*a* longitudinally upward. In a condition where automatic packer 100 is set before actuation of extendable perforator 130*a*, a force may be applied to extendable perforator 130*a*, thereby forcing extendable perforator 130*a* upwardly. Examples of forces that may be applied may include springs in tension, release of a pressurized gas or other fluid, pneumatic movement, detonation, etc. As illustrated, expanded arms 190 of well retention device 170, as well as solid portions (not shown) facilitate the expansion of extendable perforator 130. When wire 155 of extendable perforator 130 is substantially fully extended longitudinally within well 245, the well retention device 170 engages the inner wall of well 245, thereby holding and locking extendable perforator 130*a* into place. In an expanded position, perforation charges 150 may be spaced within the well 245 as desired by the operator.

Fluid flow as well as gravity forces extendable perforator 130*b* longitudinally downward within well 245. As illustrated, expanded arms 190 of well retention device 170, as well as solid portions (not shown) facilitate the extension of extendable perforator 130. When wire 155 of extendable perforator 130 is substantially fully extended longitudinally within well 245, the well retention device engages the inner wall of well 245, thereby holding and locking extendable perforator 130*b* into place. In an expanded position, perforation charges 150 may be spaced within the well 245 as desired by the operator.

After expansion of extendable perforators 1301/130*b*, the perforation charges 150 may be detonated in order to perforate the well 245.

Figure 21:
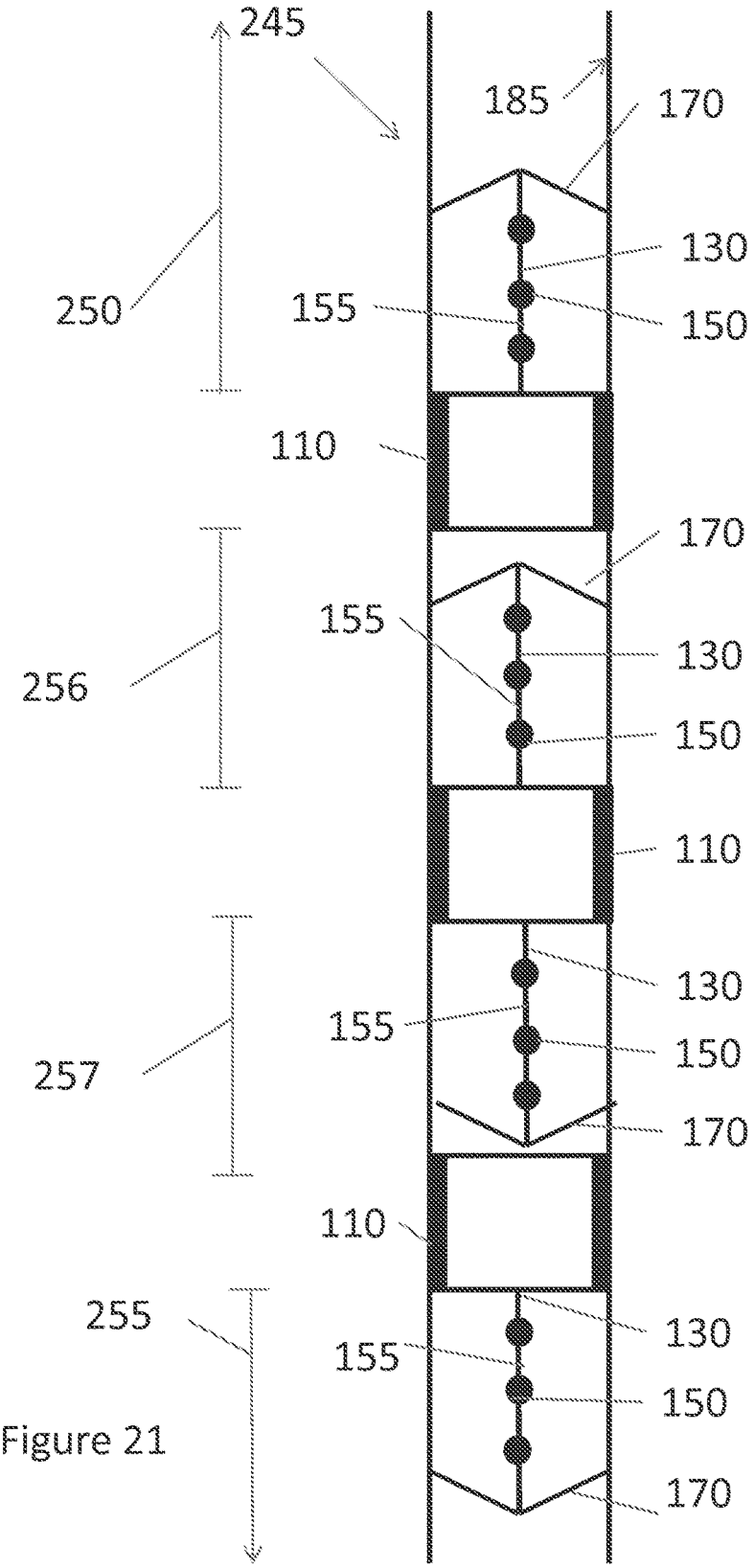
FIG. 21 is a cross-sectional view of multiple automatic packers in a well according to embodiments of the present disclosure.

Referring to FIG. 21, a cross-sectional view of a well 245 having multiple isolated zones according to embodiments of the present disclosure is shown. In this embodiment, three automatic packers 100*a*, 100*b*, and 100*c*, are deployed in a well 245. Automatic packer 100*a* divides a top partition 250, automatic packer 100*b* divides a first middle partition 256 from a second middle partition 257, and automatic packer 100*c* divides second middle partition 257 from bottom partition 255. In such an embodiment, the well 245 is divided into four discrete and isolated zones, 250, 256, 257, and 255, from which separate perforation operations may be performed.

As explained above, automatic packers 100*a*, 100*b*, and 100*c*, each have at least one extendable perforator 130. Each extendable perforator 130 has a wire 155 with a plurality of charges 155. Additionally, the extendable perforators 130 have well retention devices 170.

During operation, automatic packer 100*c* was initially disposed in the well 245. Automatic packer 100*b* was deployed second, and automatic packer 100*a* was deployed last. Depending on the requirements of the operation, one or more of automatic packers 100 may be deployed at the same time, each with a different preselected actuation depth or other actuation criteria, such as, for example, casing collar locators/position, tachometer measurements, temperature, pressure, etc. Upon reaching the preselected depth, automatic packer 100*c* actuates, radially expanding sealing element 110 into engagement with well wall 185. Automatic packers 100*b* and 100*a* also fell within the well 245 to different preselected depths before actuating. Depending on the preselected depth differences between the automatic packers 100, automatic packer 100*a* may actuate before automatic packer 100*b* and/or 100*c* reaches its respective preselected actuation depth. The order of actuation is not significant, as the automatic actuation will allow each automatic packer 100 to fall freely to its individual preselected depth prior to actuation.

After actuation of automatic packers 100*a*, 100*b*, and 100*c*, actuation of extendable perforators 130 may occur. Depending on the requirements of the operation, the individual extendable perforators 130 may occur directly after actuation of sealing elements 110. In other embodiments, extendable perforators 130 may actuate a set time period after sealing elements. In still other embodiment, extendable perforators 130 may actuate on a different measured criteria. For example, in one embodiment, sealing elements 110 of automatic packers 100 may actuate based on a position indicator, which extendable perforators 130 may actuate based on a pressure differential or a measured pressure. In still other embodiments, both sealing element 110 actuation and extendable perforator 130 actuation may occur at substantially the same time. For example, in such an embodiment, the actuation of sealing element 110 may cause the deployment of extendable perforator 130. In still another embodiment, extendable perforator 130 may deploy first, with the actuation of sealing elements 110 following thereafter.

In certain embodiments, extendable perforators 130 may actuate on an external device or through wireless transmission. For example, during a hydraulic fracture job, a ball may be dropped from the surface with a unique transmitting signal, size, shape, or magnetic actuation, which when the PLC in the automatic packer 100 senses or receives, the PLC determines it may actuate automatic packer 100. For example, the PLC may control automatic packer 100 to deploy extendable perforator 130, isolate a section of the well, or provide another specific action. In still another embodiment, the automatic packer 100 may be actuated through a wireless transmission from the surface or from an e-line lowered into the well, thereby providing a wireless signal to one or more of the packers 100.

As illustrated, automatic packer 100*a* includes one extendable perforator 130 that extends into top partition 250. Automatic packer 100*b* includes two extendable perforators 130, one extends upwardly into first middle partition 256, while a second extendable perforator 130 extends downwardly into second middle partition 257. Automatic packer 100*c* includes one extendable perforator 130 that extends downwardly into bottom partition 255. Those of ordinary skill in the art will appreciate that the specific design variations of automatic packers 100 and extendable perforators 130 may vary according to design considerations for a specific operation.

After automatic packers 100 are deployed and actuated, one or more of the partitions 250, 255, 256, and/or 257 of the well 245 may be perforated. Those of ordinary skill in the art will appreciate that the individual zones maybe perforated at the same time or at different times, depending on the production schedule for the well 245.

Figure 22:
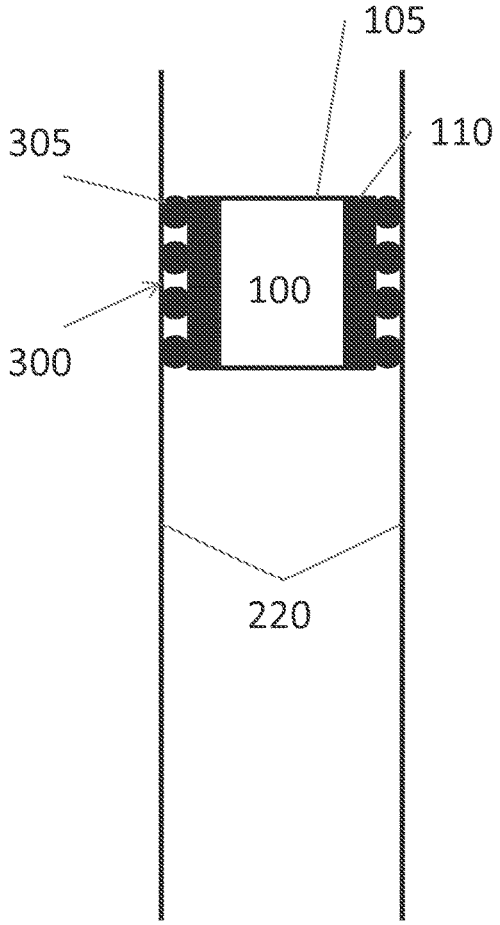
FIG. 22 is cross-sectional view of an automatic packer in a well according to embodiments of the present disclosure.

Referring to FIG. 22, a cross-sectional view of an automatic packer 100 disposed in a wellbore according to embodiments of the present disclosure is shown. In this embodiment, automatic packer 100 includes a tool body 105, a sealing element 110, and sensors (not shown). Automatic packer 100 may also include other various components necessary to actuate or control automatic packer 100 such as, for example, a data controller (not shown), a wireless transmitter (not shown), wiring (not shown), dogs (not shown), slips (not shown), etc. Automatic packer 100 also includes a motive device 300, disposed on tool body 105. As illustrated, motive device 300 is a tractor design that includes a plurality of wheels 305 held in place by a track (not specifically illustrated). In other embodiments, motive device may include wheels, propellers, rotating teeth, or any other device that is configured to move automatic packer 100 within a wellbore 220.

Automatic packer 100 have a motive device 300 may be useful in wellbores 220 that have deviated sections or lateral sections. In certain wellbores 220, the path of the wellbore 220 is not straight. Thus, there may be a number of undulating sections that move both laterally and longitudinally. In certain sections, the path of the wellbore 220 may even require the automatic packer 100 to travel upwardly to reach a desired place within the wellbore 220. In such wellbores 220, traditional packers without motive devise 300 may not be capable of reaching such sections because gravity or even fluid flow into the wellbore 220 may not be sufficient to carry automatic packer 100 to the desired location. In such a wellbore 220, automatic packer 100 having motive device 300 may be used to ensure automatic packer 100 is capable of reaching the desired location.

Motive device 300 may be controlled from the surface of the wellbore 220 using a wireless transmission tied into the data controller. In other embodiments, automatic packer 100 may be configured to actuate at a predefined depth. For example, automatic packer 100 may use one or more sensors to determine the packers place within the wellbore 220. When automatic packer 100 reaches the predefined location, as measured by the sensors, automatic packer 100 may actuate. Actuation of automatic packer 100 may include setting the sealing elements 110 to isolate a portion of the wellbore 220 or may include actuating a perforation device (not shown), as discussed in detail below. Those of ordinary skill in the art will appreciate that a motive device 300 as explained herein may be used on any of the other embodiments of automatic packer 100 discussed herein.

In certain embodiments, motive device 300 may be used to recharge the batteries of automatic packer 100 through the kinetic motion generated by automatic packer 100. In other embodiments, motive device 300 may rely on the batteries of automatic packer 100 in order to operate. In still other embodiments, motive device 300 may have batteries separate from the batteries of automatic packer 100, thereby allowing the motive device 300 to operate independently from automatic packer 100, which is discussed further below.

Figure 23:
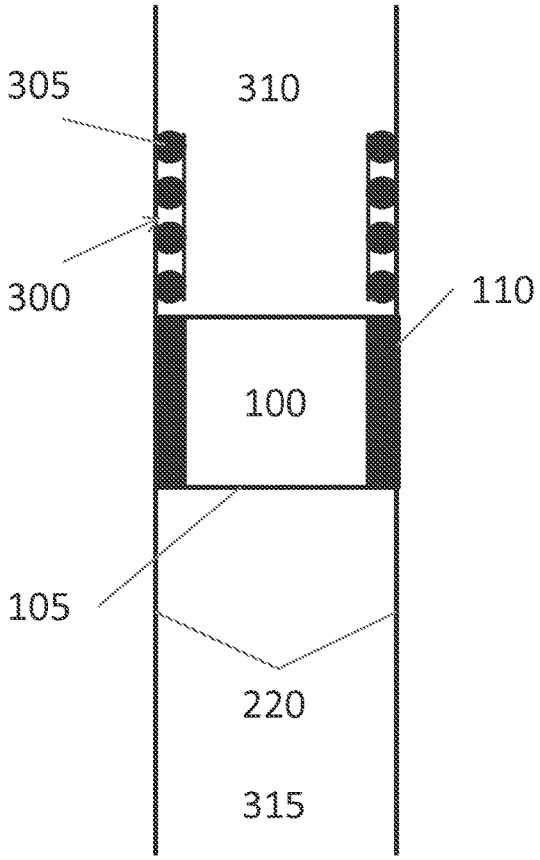
FIG. 23 is a cross-sectional view of an automatic packer in a well according to embodiments of the present disclosure.

Referring to FIG. 23, a cross-sectional view of an automatic packer 100 disposed in a wellbore according to embodiments of the present disclosure is shown. In this embodiment, automatic packer 100 includes a tool body 105, a sealing element 110, and sensors (not shown). Automatic packer 100 may also include other various components necessary to actuate or control automatic packer 100 such as, for example, a data controller (not shown), a wireless transmitter (not shown), wiring (not shown), dogs (not shown), slips (not shown), etc. Automatic packer 100 also includes a motive device 300, disposed on tool body 105.

As illustrated in FIG. 23, automatic packer 100 is shown after actuation. In this embodiment, after sensors (not shown) determined automatic packer 100 reached the predefined location within wellbore 220, the sealing elements 110 were radially expanded into contact with the wellbore 220 walls, thereby isolating the wellbore into a top portion 310 and a bottom portion 315. After actuation, automatic packer 100 may stay within the wellbore 220, however, motive device 300 may be disconnected from tool body 105 and returned to the surface. In this embodiment, motive device 300 was disconnected from tool body 105 after actuation of sealing elements 110, however, in other embodiments, motive device 300 may be disconnected from tool body 105 prior to the actuation of sealing elements 110. Motive device 300 may return to the surface of wellbore 220 through natural flow of fluids within the wellbore, or may be pulled to the surface using wireline, coiled tubing, or the like. In still other embodiments, motive device may be returned to the surface using the motive abilities of motive device 300. Because motive device 300 may be returned to the surface of the wellbore 220, motive device 300 may be reused in other packer actuation implementations.

Figure 24:
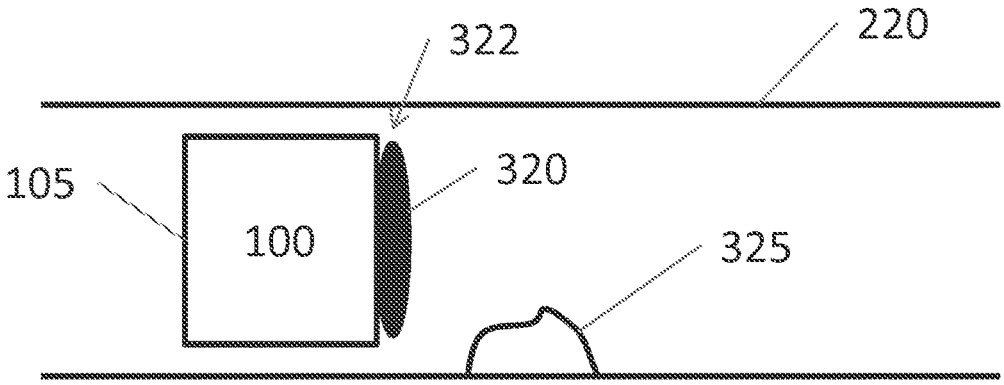
FIG. 24 is cross-sectional view of an automatic packer in a well according to embodiments of the present disclosure.

Referring to FIG. 24, a cross-sectional view of an automatic packer 100 disposed in a wellbore according to embodiments of the present disclosure is shown. In this embodiment, automatic packer 100 includes a tool body 105, a sealing element 110, and sensors (not shown). Automatic packer 100 may also include other various components necessary to actuate or control automatic packer 100 such as, for example, a data controller (not shown), a wireless transmitter (not shown), wiring (not shown), dogs (not shown), slips (not shown), etc. Automatic packer 100 also includes a drill bit 320 disposed at a lead end 322 of automatic packer 100.

In certain wellbore 220, an obstruction 325 may form at some point within the wellbore 220 that may prevent a downhole tool, such as automatic packer 110, from reaching a desired target location. Obstructions 325 may be formed from rock fragments, perforation fragments, scale build up, etc., and may be located on the walls of the wellbores 220 or within the central flow bore of the wellbore 220. Depending on the size of the obstructions 325, the obstructions 325, in additional to preventing automatic packer 100 from reaching a desired location, may restrict the flow of fluids therethrough.

As indicated above, in this embodiment automatic packer 100 includes a drill bit 320 that is configured to drill out such obstructions 325 as automatic packer 100 is run into the wellbore 100. FIG. 24 illustrates drill bit 320 in a contracted or non-actuated condition. In this condition, drill bit 320 includes a restricted diameter to prevent the drill bit 320 from contracting the walls of the wellbore 220. Drill bit 320 may include various types of drill bits 320 that are known in the art including, for example, fixed cutter (drag) bits and roller cone bits. While not explicitly shown, fixed cutter bits may include various inserts, such as tungsten carbide inserts that are press fit or brazed into the body of the bit. Such inserts may include a diamond or polycrystalline diamond layer, applied thereto, that increasing the cutting potential of the bit. Those of ordinary skill in the art will appreciate that such inserts may be disposed on fixed cutter bits having particular back and side rakes in order to optimize the cutting action of the specific inserts.

Similarly, roller cone style drill bits may be used according to embodiments of the present disclosure. Roller cone style drill bits may include one, two, three, or more cones, with each cone having a plurality of inserts disposed thereon. As with fixed cutter drill bits, the inserts of roller cone drill bits may be press fit or brazed into the individual cones and each cone and insert may be configured to optimize the cutting action of the bit. For example, inserts of various geometries may be used with roller cone bits to further increase the cutting action of the roller cone bit.

In addition to fixed cutter and roller cone drill bits, other types of drill bits may be used according to embodiments of the present invention. For example, a reamer style bit may be used in embodiments of automatic packer 100. Traditional reamers include radially expandable arms housing a plurality of cutting sections or cutting elements that are configured to cut through formation or other obstructions 325. The arms of reamers may be configured to expand in one or more directions, such as into contact with the sidewalls of a wellbore 220, thereby allowing the cutting elements that are disposed thereon to contact an obstruction 325. Those of ordinary skill in the art will appreciate that the types of drill bits 320 discussed herein are merely exemplary and any type of drill bit 320 may be disposed on automatic packer 100.

Figure 25:
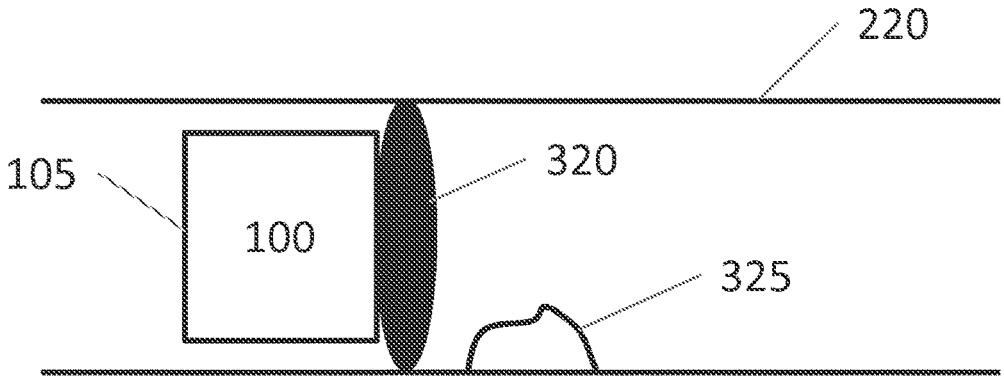
FIG. 25 is a cross-sectional view of an automatic packer in a well according to embodiments of the present disclosure.

Referring to FIG. 25, a cross-sectional view of an automatic packer 100 disposed in a wellbore according to embodiments of the present disclosure is shown. In this embodiment, automatic packer 100 includes a tool body 105, a sealing element 110, and sensors (not shown). Automatic packer 100 may also include other various components necessary to actuate or control automatic packer 100 such as, for example, a data controller (not shown), a wireless transmitter (not shown), wiring (not shown), dogs (not shown), slips (not shown), etc. Automatic packer 100 also includes a drill bit 320 disposed at a lead end 322 of automatic packer 100.

FIG. 25 shows automatic packer 100 that has encountered an obstruction 325 and actuated drill bit 320. As illustrated, drill bit 320 has radially expanded, thereby allowing drill bit to substantially fill the diameter of wellbore 220, thereby allowing obstruction 325 to be substantially removed. Drill bit 320 may be expanded through various techniques. For example, in one embodiment, drill bit 320 may be held in a collapsed or closed position through the use of, for example, lock rings, collapsed teeth, springs, or the like. When an obstruction 325 is encountered, automatic packer 100 may release drill bit 320, thereby allowing drill bit 320 to expand into an open or uncollapsed position. In order to release drill bit 320 from a closed position, automatic packer 100 may cause a burst or rupture disk to break, thereby releasing drill bit 320. In still other embodiments, hydraulic pressure may be used to release and/or hold drill bit 320 in an open position. In still other embodiments, an electric signal may be sent by automatic packer 100 to cause drill bit 320 to move into an open position. Those of ordinary skill in the art will appreciate that once open, drill bit 320 may remain in an open position. In other embodiments, automatic packer 100 may issue a second command to retract drill bit 320 into a closed position after the obstruction 325 is cleared.

Figure 26:
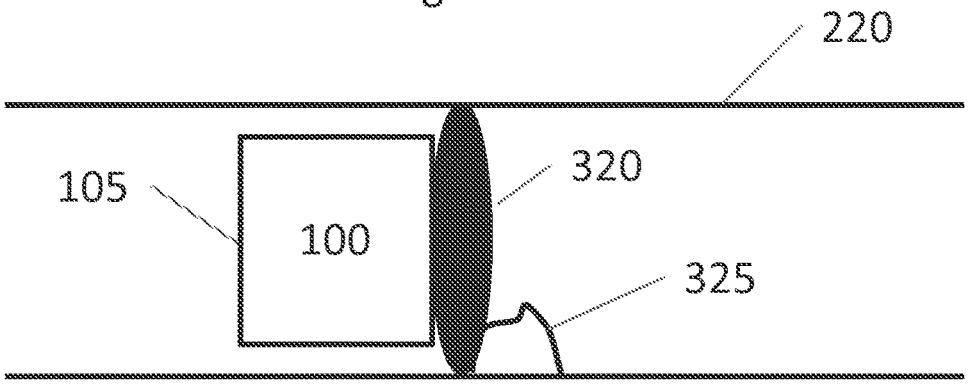
FIG. 26 is a cross-sectional view of an automatic packer in a well according to embodiments of the present disclosure.

Referring to FIG. 26, a cross-sectional view of an automatic packer 100 disposed in a wellbore according to embodiments of the present disclosure is shown. In this embodiment, automatic packer 100 includes a tool body 105, a sealing element 110, and sensors (not shown). Automatic packer 100 may also include other various components necessary to actuate or control automatic packer 100 such as, for example, a data controller (not shown), a wireless transmitter (not shown), wiring (not shown), dogs (not shown), slips (not shown), etc. Automatic packer 100 also includes a drill bit 320 disposed at a lead end 322 of automatic packer 100.

FIG. 26 shows drill bit 320 clearing obstruction 325. Drill bit 320 may clear obstruction 325 by rotating in order to cut through the obstruction, or, depending on the type of obstruction 325, contact alone without rotation may be enough to clear the obstruction 325. Rotation of drill bit 320 may include rotation of automatic packer 100, or drill bits 320 may rotate independent from automatic packer 100. In certain embodiments, automatic packer 100 having a drill bit 320 may also benefit from being disposed in wellbore 220 through use of a motive device (300 in FIG. 22). In such an embodiment, the motive device may be used to rotate drill bit 320 and/or automatic packer 100.

In certain embodiments, the data controller or PLC of the automatic packer 100 may be connected to one or more sensors in order to detect when an obstruction 325 exists. The data controller/PLC along with the sensors may also be used to determine when the obstruction 325 has been cleared.

Figure 27:
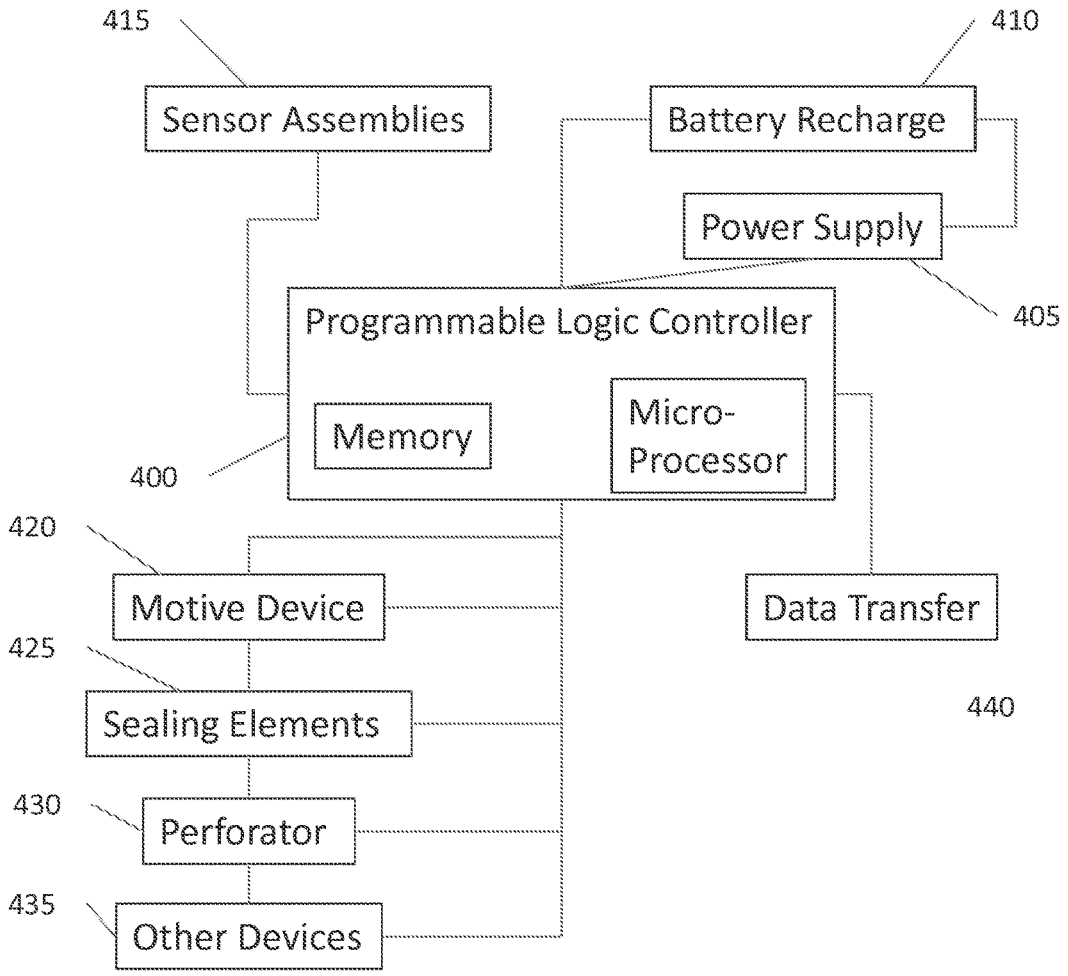
FIG. 27 is a schematic representation of the functionality of an automatic packer according to embodiments of the present disclosure.

Referring to FIG. 27, a schematic representation of an automatic packer according to embodiments of the present disclosure is shown. FIG. 27 provides a schematic overview of the different actuations that an automatic packer may be configured for. Those of ordinary skill in the art will appreciate that not every function much be present on every embodiment. In certain embodiments, the automatic packer may be used to achieve one goal, while in other embodiments, the automatic packer may have a number of different responsibilities while downhole.

Unlike existing packers that serve a single function of being run into a wellbore than then actuated to isolate a portion of the wellbore, the automatic packer disclosed herein includes a programmable logic controller (PLC) that includes, for example, a microprocessor and a memory (400). The memory may be used to store data that is gather downhole or may be used to store instructions for causing the automatic packer to perform specific functions downhole. For example, the PLC may be used to automatic cause the automatic packer to actuate sealing elements at a particular location within a wellbore. PLC may also be used to drive a motive device to a particular location within a wellbore, deploy a perforator at a desired location, or to control other devices.

PLC is connected to a power supply (405), which may also be connected to a battery recharge system (410). The power supply (405) may include a battery, such as a rechargeable lithium ion battery, that powers the PLC while the automatic packer is in the wellbore. The battery recharge system (410) may provide recharge to the battery through, for example, downhole heat induction, flowing phases through a turbine or turbine blades, kinetic recharging, movement, etc. Those of ordinary skill in the art will appreciate that any type of recharging system may be used to recharge the power supply while the automatic packer is downhole. Additionally, in certain embodiments, the battery recharge system may be configured to connect to a wellbore surface power supply through wires, thereby allowing the automatic packer to be powered from the surface or to allow the power supply to be recharged from the surface.

The automatic packer also includes one or more sensor assemblies (415). The sensor assemblies may include sensors for measuring a temperature, a pressure, a fluid type, a density, a specific gravity, an induction, a conduction, a refraction, infrared signal, a fiber optic signal, a load, an acceleration, a velocity, an ultrasonic signal, a tachometer measurement, a wireless transmission, a gyroscopic measurement, a casing collar locator measurement, various types of logging tools, imaging tools, modular formation dynamic testing tools, a modular reservoir dynamic test measurement, and/or a position within the well. The sensor assemblies (415) may be connected directly to the PLC (400), thereby allowing the PLC to know the conditions in the wellbore that may affect the automatic packer. Based on the measurements of the sensor assemblies (415), the PLC may carry out predefined instruction, thereby allowing the automatic packer to act independently from the surface of the wellbore.

As explained in detail above, the automatic packer disclosed herein is capable of performing a number of different actuations while downhole. Because the automatic packer is equipped with a PLC (400) capable of automatically actuating different aspects of the automatic packer, the automatic packer is capable of performing number functions during a single trip into a wellbore. PLC may be used to control a motive device (420) of the automatic packer. For example, the PLC may be programmed with instructions to drive to a particular depth within a wellbore. The motive device (420) may be actuated by the PLC (400) to start going down within a wellbore. The sensor assemblies (415) may substantially continuously measure the progress of the automatic packer within the wellbore. When the sensor assemblies (415) measure the desired depth, the PLC (400) may send a control signal to the motive device (420) effectively telling the movement to stop. Thus, PLC (415) may be used to control the depth to which the automatic packer progresses within a wellbore.

The automatic packer may also include one or more sealing elements (425). When sensor assemblies (415) provide information to PLC (400) indicating a predefined location for deployment has occurred, the PLC (400) may actuate sealing elements (425), thereby isolating a portion of the wellbore. Similarly, the PLC (400) may be used to actuate one or more perforators (430). As explained above, the PLC (400) may include instructions to both expand the perforators (430) as well as instructions that cause the perforators (430) to detonate at a particular location.

In addition to sealing and perforating a wellbore, the PLC (400) may also be used to control other devices (435). For example, PLC (400) may be used to control a drilling operation of the automatic packer. As previously explained in detail, automatic packer may be equipped with one or more different types of drill bits. In one embodiment, the PLC (400) may be used to control a laterally drilling drill bit that is capable of drilling and placing perforation charges. In other embodiments, PLC (400) may be used to actuate and drill out an obstruction in the wellbore. In either case, PLC (400) may use inputs from the sensor assemblies (415) in order to determine when and where to drill. Those of ordinary skill in the art will appreciate that PLC (400) may also be used to control other devices (435) that may be disposed on the automatic packer.

PLC (400) may also be used to transfer data (440). For example, in one embodiment, the automatic packer may be disposed downhole at a desired depth and actuated to seal the wellbore. The sensor assemblies (415) may then be used to gather data about the sealed section of the wellbore. When the desired data is acquired, PLC (400) may instruct the automatic packer to provide a data transfer (440), thereby sending the acquired data to the surface. The data transfer (440) may use a wireless connection, or alternatively, may be sent through wires or drill pipe that is connected to the surface.

PLC (400) may thus be used to both receive and send control signs for controlling the operations of the automatic packer downhole. In addition to controlling the actions of the automatic packer while downhole, the PLC (400) may be configured to receive control signals from the surface that change the instructions or functionality of the automatic packer. For example, based on the data gathered by the automatic packers while downhole, a control signal from the surface may be sent to PLC (400) providing instructions for performing another downhole operation. Examples of downhole operations that may be modified include sealing a different section of the wellbore, moving to a different location to perform data gathering, perforating a section of a wellbore, drilling a section of a wellbore, and the like. Because the automatic packer has a PLC (400) that allows data to be sent and received, a wellbore engineer at the surface may have greater control over aspects of the operation. For example, based on the information gathered by the automatic packer and sent to the surface, one or more wellbore parameters may be adjusted. Examples of wellbore parameters that may be adjusted in response to data gathered by the automatic packer include, a fluid flow rate, a fluid type, a type of perforation, a production interval, a production location, etc.

According to still other embodiments of the present invention, the downhole tool my not include the same components as the automatic packer, described above. For example, in certain embodiments, the downhole tool may be an automatic driller. Automatic drillers, according to embodiments of the present disclosure are discussed in detail below.

Figure 28:
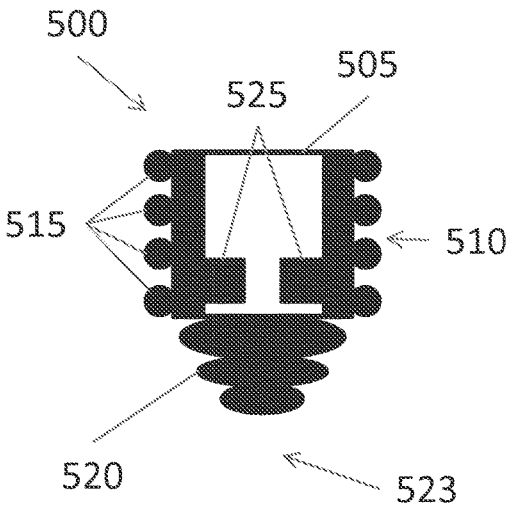
FIG. 28 is a side cross-sectional view of an automatic driller according to embodiments of the present disclosure.

Referring to FIG. 28, a side cross-sectional view of an automatic driller according to embodiments of the present disclosure is shown. In this embodiment, automatic driller 500 includes a tool body 505. Tool body 505 may be formed from various metals, metal alloys, polymers, composites, and combinations thereof. For example, in one embodiment, tool body 505 may be formed from a ductile or malleable metal or metal alloy, thereby allowing the tool body 505 to flex under tensile or compressive stress. The plasticity of tool body 505 may thereby allow tool body 505 to flex during operation of automatic driller 500 such that tool body 505 and thus automatic driller 500 may conform to the profile of a well. Similarly, tool body 505 may be formed from various polymers and/or composites having sufficient plasticity to allow tool body 505 and thus automatic driller 500 to conform to the profile of a well. In certain embodiments, tool body 505 may have relatively high tensile strength and be sized smaller than the inner diameter of the downhole tubulars or open hole wellbore.

Automatic driller 500 also includes a motive device 510. As explained above with respect to embodiments of the automatic packer, motive device 510 may include a plurality of wheels 515 or tracks (not independently shown). The wheels 515 may roll along the inner diameter of a well, or casing (if the well is cased or open hole), thereby allowing automatic driller 500 to move independently within a well. In still other embodiments, rather than wheels or tracks, the motive device 510 of automatic driller 500 may include a plurality of single or double rotating dog slips on each of automatic driller 500. The wheels may be formed from various metals, metal alloys, polymers, composites, rubbers, and combinations thereof. For example, in one embodiment, wheels may be formed from a rubber or rubber compound disposed around a metal or polymer frame (not independently shown). In this embodiment, automatic driller 500 is illustrated as having two sets of motive device 510, however, in other embodiments, automatic driller 500 may have more than two sets of motive devices. For example, automatic driller 500 may have three, four, five, or more sets of motive devices 510 concentrically disposed around tool body 505. The number of motive devices 510 may depend on the diameter of the well, the operational parameters of automatic driller 500, and/or the operational requirements for a particular automatic driller 500.

Automatic driller 500 further includes a drill bit 520 disposed at a distal end 523 of tool body 505. Various types of drill bits 520 may he used according to embodiments of the present disclosure. Examples of drill bits 520 that may be disposed on tool body 505 include polycrystalline diamond compact drill bits ("PDC bit"), also known in the art as fixed-cutter bits and/or drag bits. PDC bits include a plurality of cutters (not independently shown) that shear formation or other substances with a substantially continuous scraping motion. Cutters are typically formed from synthetic or natural diamond, which are disposed on a cone (notindependently shown). The cone is rotated relative to tool body 505 so that the cutters shear formation or other downhole substances.

In addition to PDC drill bits, drill bit 520 may also include a roller cone drill bit. Roller cone drill bits include one or more roller cones having a plurality of cutters disposed thereon. In certain embodiments, a roller cone drill bit may include one, two, three, or more cones that intermesh, thereby causing the tool to crush formation or other substances. During operation, the cones of the roller cone drill bit are rotated along the bottom of a well. As the cones rotate, the cutters contact the formation or other substance, crushing the formation or other substance and allowing the crushed substance to be removed from the bottom of the well. Examples of roller cone bits may include steel milled-tooth bits as well as carbide insert bits. The cutters of roller cone drill bits may be formed from metal and metal alloys, carbide, diamond, and other materials. Examples of types of cutters may include tungsten carbide cutters, diamond enhanced cutters, and cutters formed from other ultra-hard materials.

Drill bit 520 may also be capable of being collapsed within tool body 505. In such an embodiment, drill bit 520 may be supported by one or more springs (not shown) disposed within tool body 505. In certain embodiments, rather than springs, alternative mechanical, electrical, hydraulic, pneumatic, or pressurized locking/expandable mechanisms may be used. While collapsed, either entirely or partially within tool body, the spring may be in compression. Upon actuation, the spring may be released, thereby allowing drill bit 520 to expand out of tool body 505. In certain embodiments, in addition to drill bit 520 being collapsible within tool body 505, drill bit 520 may be radially compressible. In such an embodiment, in a run-in-hole state, drill bit 520 may have a smaller outer diameter than in an operational state. For example, as automatic driller 500 is run-in-hole, the drill bit may have an outer diameter such that the drill bit 520 may fit partially or entirely within tool body 505.

During an operational state, the drill bit 520 may be radially expanded, thereby increasing the outer diameter of drill bit 520 to substantially match the inner diameter of a well. In order to radially compress drill bit 520, one or more springs may hold drill bit 520 in compressed, run-in-state prior to actuation of automatic driller 500. Release of the springs may thereby allow drill bits 520 to radially expand to an operational state. Those of ordinary skill in the art will appreciate that in other embodiments, drill bit 520 may be collapsed and/or compressed without the use of springs or other mechanically restrictive devices. In such embodiments, drill bit 520 may remain collapsed and/or compressed prior to pneumatic or hydraulic actuation of automatic driller 500. Thus, in certain embodiments, drill bit 520 may remain collapsed and/or compressed prior to a fluid being used to actuate drill bit 520.

Automatic driller 500 may also include one or more setting tools 525. Setting tools 525 may include radially expandable projections that are configured to hold automatic driller 500 in place during operation. Setting tools 525 will be discussed in detail below during discussion of the operation of automatic driller 500. However, generally, setting tools 525 may be formed from metals, metal alloys, polymers, and or composites, and may be configured to expand from tool body 505 into contact with a well or well casing. The setting tools 525 may include a plurality of teeth (not independently shown) that are configured to grip the inner diameter of the well or well casing, thereby holding automatic driller 500 in a desired position or orientation during automatic driller actuation. In this embodiment, automatic driller 500 includes two setting tools 525, however, those of ordinary skill in the art will appreciate that in other embodiments, automatic driller 500 may include one, two, three, four, or more setting tools 525.

Automatic driller 500 may also include various other components that allow automatic driller 500 to operate downhole independently. As discussed above with respect to the automatic packer, automatic driller 500 may include a rechargeable battery (not independently shown), a computer, such as a data controller or a programmable logic controller ("PLC") (not independently shown), a memory storage device (not independently shown), a wireless transmitter or transceiver (not independently shown), and multiple sensors (not independently shown). Examples of sensors that may be included with automatic drill 500 include sensors that may measure a temperature, a pressure, a fluid type, specific gravity spinner, induction, conduction, refraction, infrared, a load, an acceleration, a velocity, a fiber optic signal, an ultrasonic signal, a tachometer measurement, a wireless transmission, a gyroscopic measurement, a casing collar locator, various type of logging tools, imaging tools, modular formation dynamic testing tools, a modular reservoir dynamic test, and/or a position within the well. Generally, those of ordinary skill in the art will appreciate that the sensors may be used to determine a location of the automatic driller 500 within a well, as well as determine whether obstructions may exist within the well. If an obstruction is located, the automatic driller 500 may be actuated in order to clear the obstruction from the well. Additionally, the sensors may be used to determine the location of automatic driller 500 within a well, thereby allowing a secondary borehole to be cut or sidetracked from the well. The operation of automatic driller 500 is discussed in detail below.

Figure 29:
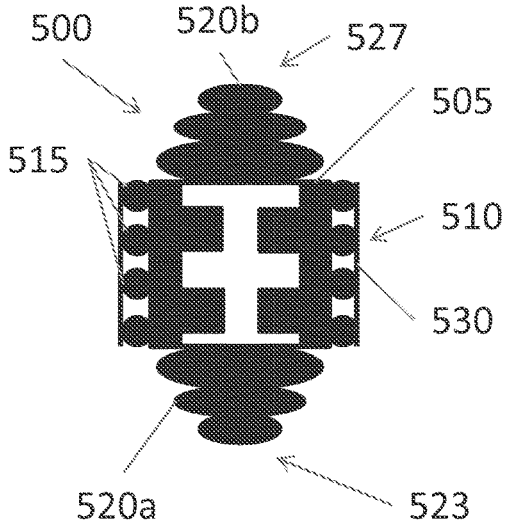
FIG. 29 is a side cross-sectional view of an automatic driller according to embodiments of the present disclosure.

Referring to FIG. 29, a side cross-sectional view of an automatic driller 500 according to embodiments of the present disclosure is shown. In this embodiment, automatic driller 500 includes a tool body 505. Tool body 505 may be formed from various metals, metal alloys, polymers, composites, and combinations thereof. For example, in one embodiment, tool body 505 may be formed from a ductile or malleable metal or metal alloy, thereby allowing the tool body 505 to flex under tensile or compressive stress. The plasticity of tool body 505 may thereby allow tool body 505 to flex during operation of automatic driller 500 such that tool body 505 and thus automatic driller 500 may conform to the profile of a well. Similarly, tool body 505 may be formed from various polymers and/or composites having sufficient plasticity to allow tool body 505 and thus automatic driller 500 to conform to the profile of a well. In certain embodiments, tool body 505 may have relatively high tensile strength and be sized smaller than the inner diameter of the downhole tubulars or open hole wellbore.

Automatic driller 500 also includes a motive device 510. As explained above with respect to embodiments of the automatic packer, motive device 510 may include a plurality of wheels 515 or tracks 530. In still other embodiments, rather than wheels or tracks, the motive device 510 of automatic driller 500 may include a plurality of single or double rotating dog slips on each of automatic driller 500. In this embodiment, motive device 510 includes a plurality of wheels 515 disposed on tracks 530. Wheels 515 disposed in tracks 530 may thereby allow the wheels 515 to rotate as a single unit, thereby allowing automatic driller 500 better grip and/or stability within the well. The wheels 515 may be formed from various metals, metal alloys, polymers, composites, rubbers, and combinations thereof. For example, in one embodiment, wheels may be formed from a rubber or rubber compound disposed around a metal or polymer frame (not independently shown). Tracks 530 may be formed from various metals, metal alloys, polymers, composites, rubbers, and combinations thereof. In this embodiment, automatic driller 500 is illustrated as having two sets of motive device 510, however, in other embodiments, automatic driller 500 may have more than two sets of motive devices. For example, automatic driller 500 may have three, four, five, or more sets of motive devices 510 concentrically disposed around tool body 505. The number of motive devices 510 may depend on the diameter of the well, the operational parameters of automatic driller 500, and/or the operational requirements for a particular automatic driller 500.

Automatic driller 500 further includes a drill bit 520 disposed at a distal end 523 of tool body 505. Various types of drill bits 520 may be used according to embodiments of the present disclosure. Examples of drill bits 520 that may be disposed on tool body 505 include PDC bits. In addition to PDC drill bits, drill bit 520 may also include, but not limited to, a roller cone drill bit.

Drill bit 520 may also be capable of being collapsed within tool body 505. In such an embodiment, drill bit 520 may be supported by one or more springs (not shown) disposed within tool body 505. In certain embodiments, rather than springs, alternative mechanical, electrical, hydraulic, pneumatic, or pressurized locking/expandable mechanisms may be used. While collapsed, either entirely or partially within tool body, the spring may be in compression. Upon actuation, the spring may be released, thereby allowing drill bit 520 to expand out of tool body 505. In certain embodiments, in addition to drill bit 520 being collapsible within tool body 505, drill bit 520 may be radially compressible. In such an embodiment, in a run-in-hole state, drill bit 520 may have a smaller outer diameter than in an operational state. For example, as automatic driller 500 is run-in-hole, the drill bit may have an outer diameter such that the drill bit 520 may fit partially or entirely within tool body 505.

During an operational state, the drill bit 520 may be radially expanded, thereby increasing the outer diameter of drill bit 520 to substantially match the inner diameter of a well. In order to radially compress drill bit 520, one or more springs may hold drill bit 520 in compressed, run-in-state prior to actuation of automatic driller 500. Release of the springs may thereby allow drill bits 520 to radially expand to an operational state. Those of ordinary skill in the art will appreciate that in other embodiments, drill bit 520 may be collapsed and/or compressed without the use of springs or other mechanically restrictive devices. In such embodiments, drill bit 520 may remain collapsed and/or compressed prior to electrical, pneumatic, or hydraulic actuation of automatic driller 500. Thus, in certain embodiments, drill bit 520 may remain collapsed and/or compressed prior to a fluid being used to actuate drill bit 520.

In this embodiment, automatic driller 500 includes two drill bits 520, a first drill bit 520*a* disposed at a distal end 523 of automatic driller 500 and a second drill bit 520*b* disposed at a proximate end 527 of automatic driller 500. As illustrated, first and second drill bits 520*a*/520*b* are substantially the same, however, in other embodiments, first and second drill bits 520*a*/520*b* may be of different size, geometry, or form. For example, in certain embodiments, first drill bit 520*a* may be a primary drill bit 520, while second drill bit 520*b* may be a secondary drill bit 520 that is designed to clear obstructions as automatic driller 500 returns to a connector (not shown) to be recharged. In such an embodiment, second drill bit 520*b* may be smaller or otherwise less substantial than first drill bit 520*a*. Additionally, in certain embodiments, the type of drill bit 520 used may differ. For example, in one embodiment, first drill bit 520*a* may be a PDC bit, while second drill bit 520*b* may be a roller cone drill bit. In still other embodiments, first drill bit 520*a* may not have to be compressed or collapsed, while second drill bit 520*b* may have to be compressed or collapsed to allow automatic driller 500 to be recharged. Those of ordinary skill in the art will appreciate that the first and second drill bits 520*a*/520*b* may vary according to the requirements of a drilling or well cleaning operation.

Automatic driller 500 may also include one or more setting tools 525. Setting tools 525 may include radially expandable projections that are configured to hold automatic driller 500 in place during operation. Setting tools 525 will be discussed in detail below during discussion of the operation of automatic driller 500. However, generally, setting tools 525 may be formed from metals, metal alloys, polymers, and or composites, and may be configured to expand from tool body 505 into contact with a well or well casing. The setting tools 525 may include a plurality of teeth (not independently shown) that are configured to grip the inner diameter of the well or well casing, thereby holding automatic driller 500 in a desired position or orientation during automatic driller actuation. In this embodiment, automatic driller 500 includes two setting tools 525, however, those of ordinary skill in the art will appreciate that in other embodiments, automatic driller 500 may include one, two, three, four, or more setting tools 525.

Automatic driller 500 may also include various other components that allow automatic driller 500 to operate downhole independently. As discussed above with respect to the automatic packer, automatic driller 500 may include a rechargeable battery (not independently shown), a data controller or a programmable logic controller ("PLC") (not independently shown), a memory storage device (not independently shown), a wireless transmitter or transceiver (not independently shown), and multiple sensors (not independently shown). Examples of sensors that may be included with automatic drill 500 include sensors that may measure a temperature, a pressure, a fluid type, specific gravity spinner, induction, conduction, refraction, infrared, a load, an acceleration, a velocity, a fiber optic signal, an ultrasonic signal, a tachometer measurement, a wireless transmission, a gyroscopic measurement, a casing collar locator, a modular reservoir dynamic test, and/or a position within the well. Generally, those of ordinary skill in the art will appreciate that the sensors may be used to determine a location of the automatic driller 500 within a well, as well as determine whether obstructions may exist within the well. The sensors may also be used to log data or image data for contemporaneous or later processing/viewing. If an obstruction is located, the automatic driller 500 may be actuated in order to clear the obstruction from the well. Additionally, the sensors may be used to determine the location of automatic driller 500 within a well, thereby allowing a secondary borehole to be cut or sidetracked from the well. The operation of automatic driller 500 is discussed in detail below.

Figure 30:
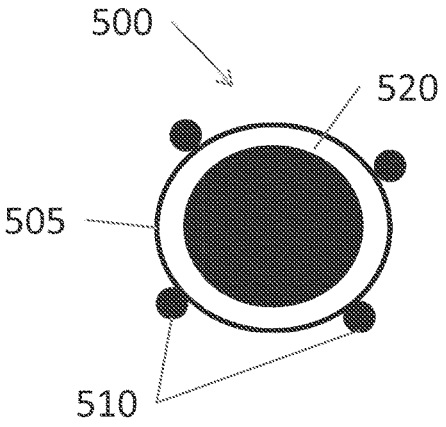
FIG. 30 is a top view of an automatic driller according to embodiments of the present disclosure.

Referring to FIG. 30, a top view of an automatic driller 500 according to embodiments of the present disclosure is shown. In this embodiment, automatic driller 500 is shown having a tool body 505 a drill bit 520 and a plurality of motive devices 510. In this embodiment, there are four motive devices 510 disposed along the outer diameter of tool body 505. In other embodiments, more or less than four motive devices 510 may be disposed along the outer diameter of tool body 505. For example, in certain embodiments, two, three, five, six, or more motive devices 510 may be disposed on the outer diameter of tool body 505. As explained above, in certain embodiments, motive devices 510 may include wheels and/or tracks.

In this embodiment, automatic driller 500 is illustrated in a run-in-hole condition, as drill bit 520 is collapsed and/or compressed and has an outer diameter that is less than the outer diameter of tool body 505. Additionally, setting tools 525 are not expanded, thereby allowing the automatic driller 500 to move freely within a well. Those of ordinary skill in the art will appreciate that not all drill bits 520 have to be collapsed and/or compressed in a run-in-hole state. For example, as long as the outer diameter of drill bit 520 is smaller than the inner diameter of the well or well tubular, automatic driller 500 may move freely within a well. However, in certain embodiments it may be advantageous to further decrease the outer diameter of drill bit 520 during run-in-hole conditions to prevent getting stuck or causing unintentional damage to the well.

Figure 31:
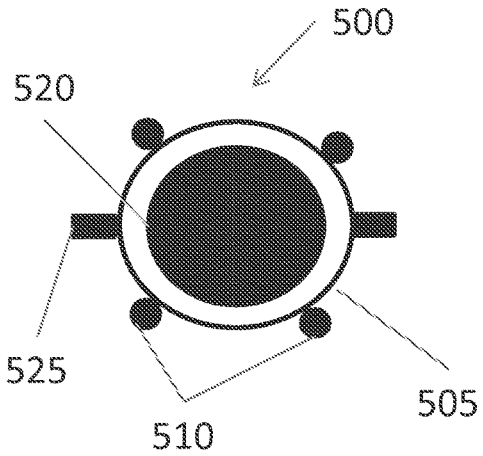
FIG. 31 is a top view of an automatic driller according to embodiments of the present disclosure.

Referring to FIG. 31, a top view of an automatic driller 500 according to embodiments of the present disclosure is shown. In this embodiment, automatic driller 500 is shown having a tool body 505 a drill bit 520 and a plurality of motive devices 510. In this embodiment, there are four motive devices 510 disposed along the outer diameter of tool body 505. In other embodiments, more or less than four motive devices 510 may be disposed along the outer diameter of tool body 505. For example, in certain embodiments, two, three, five, six, or more motive devices 510 may be disposed on the outer diameter of tool body 505. As explained above, in certain embodiments, motive devices 510 may include wheels and/or tracks.

In this embodiment, automatic driller 500 is illustrated setting tools 525 in an actuated condition. In an actuated condition, setting tools 525 may radially expand from tool body 505 into contact with a well wall or well casing. In an expanded condition, the setting tools 525 may thereby stabilize automatic driller 500, allowing drill bit 520 to clear an obstruction or drill a secondary borehole. Automatic driller 500 is illustrated as having two setting tools 525, however, in other embodiments, more than two, such as three, four five or more setting tools 525 may be disposed on tool body. Additionally, those of ordinary skill in the art will appreciate that in certain embodiments, not every setting tool 525 may contact the well or well casing during actuation. For example, in certain embodiments only one of two, two of three, etc., may contact the well or well casing.

Figure 32:
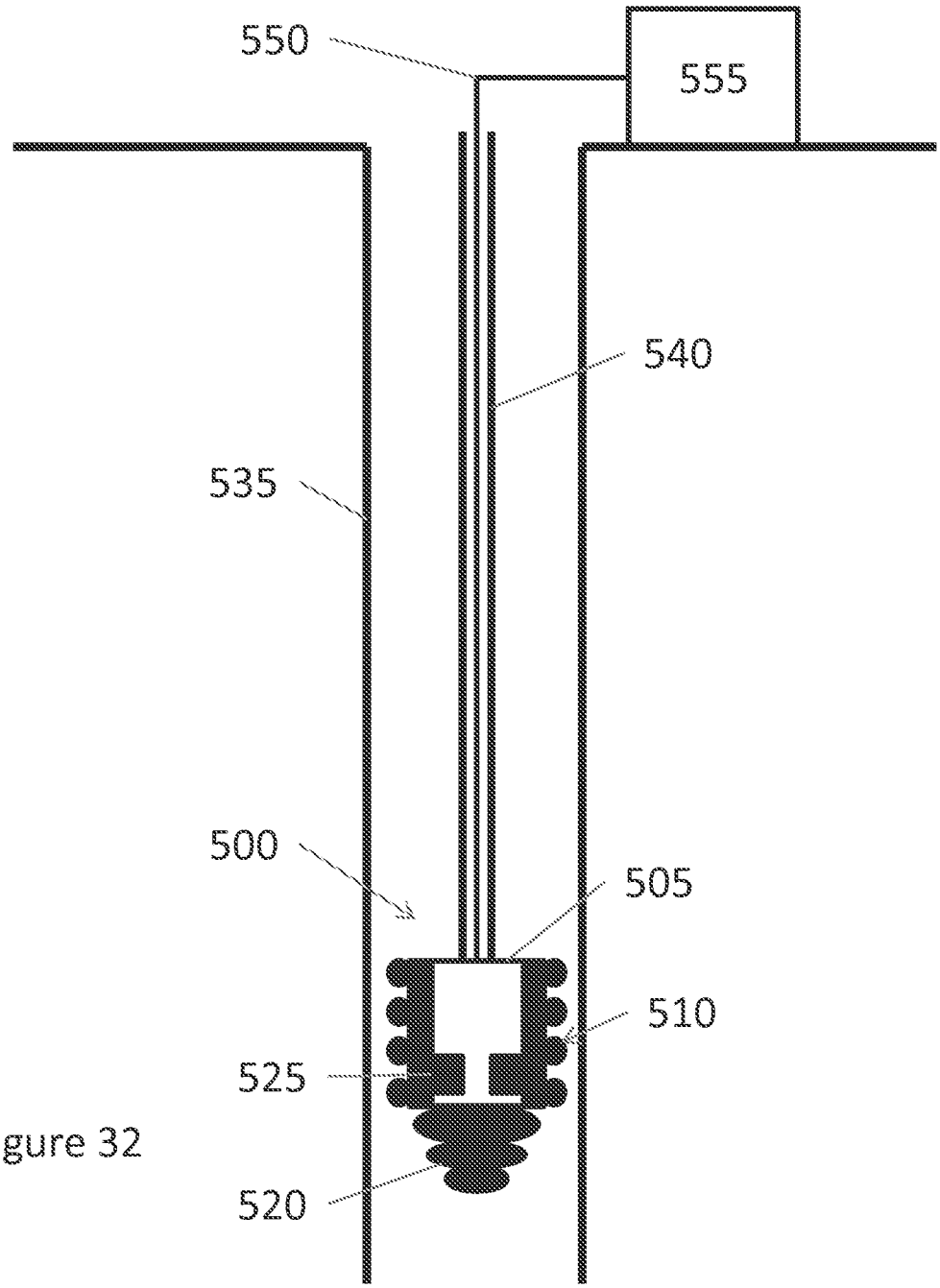
FIG. 32 is a cross-sectional view of a well according to embodiments of the present disclosure.

Referring to FIG. 32 a cross-sectional view of an automatic driller 500 disposed in a well is shown. In FIG. 32, an automatic driller 500 is shown as it is being disposed in a well 535 in a run-in-hole state. As described above in detail, automatic driller 500 includes a tool body 505 with a plurality of motive devices 510 disposed thereon. Automatic driller 500 also includes a drill bit 520 and setting tools 525. Automatic driller 500 may also include other various components that are not expressly illustrated. For example, automatic driller 500 may further include a rechargeable battery (not independently shown), a data controller or a programmable logic controller ("PLC") (not independently shown), a memory storage device (not independently shown), a wireless transmitter or transceiver (not independently shown), logging and imaging tools, and multiple sensors (not independently shown). Examples of sensors that may be included with automatic drill 500 include sensors that may measure a temperature, a pressure, a fluid type, specific gravity spinner, induction, conduction, refraction, infrared, a load, an acceleration, a velocity, a fiber optic signal, an ultrasonic signal, a tachometer measurement, a wireless transmission, a gyroscopic measurement, a casing collar locator, logging tools, imaging tools, modular formation dynamic testing tools, a modular reservoir dynamic test, and/or a position within the well.

Automatic driller 500 may initially be run-in-hole on a tubular 540. Examples of tubulars 540 that may be used include pipe, coiled tubing, wireline, electric line, flat pack, and the like. As such, tubulars 540 may be formed from metal and metal alloys, polymers, composites, and other materials capable of holding and lowering automatic driller 500 into well 535.

In this embodiment, automatic driller 500 is illustrated being lowered into well 535 on a tubular 540 that has a central conduit 545 through which an electric line 550 may be run. Electric line 550 is configured to connect automatic driller 500 to a surface-based power source 555. The surface-based power source 555 may include a generator or other electric source capable of providing electricity to automatic driller 500 when automatic driller 500 is connected to tubular 540. While automatic driller 500 is shown connected to tubular 540, those of ordinary skill in the art will appreciate that automatic driller 500 may have an electrical input (not independently shown) that is configured to mate with a second electrical input (not independently shown) that is disposed on tubular 540. The mated first and second electrical inputs may thereby be used to provide power to automatic driller 500, thereby allowing a power source, such as a battery, of automatic driller 500 to be recharged.

During operation, the power source of automatic driller 500 may be charged or in a charging condition as automatic driller 500 is lowered into the well 535. During actuation of automatic driller 500, automatic driller 500 may disconnect from tubular 540, thereby allowing automatic driller 500 to run off its independent power source. Automatic driller 500 may then complete an operation, which will be discussed in detail below. When automatic driller 500 completes an operation or is otherwise low on power, automatic driller 500 may return and connect to tubular 540, thereby allowing the power source of automatic driller 500 to be recharged. Because tubular 540 is connected to a surface-based power source 555, the automatic driller 500 may be recharged numerous times before having to be returned to the surface. Thus, automatic driller 500 may perform multiple operations without requiring tripping of the tubular 540 and automatic driller 500. In another embodiment the electrical conduit can be connected to the automatic driller at all times, even when it disconnects from the tubular, to have continual charge, receive/transmit data, logging, reprogram, and have the option to control the automatic driller 500 from the surface in real time.

Figure 33:
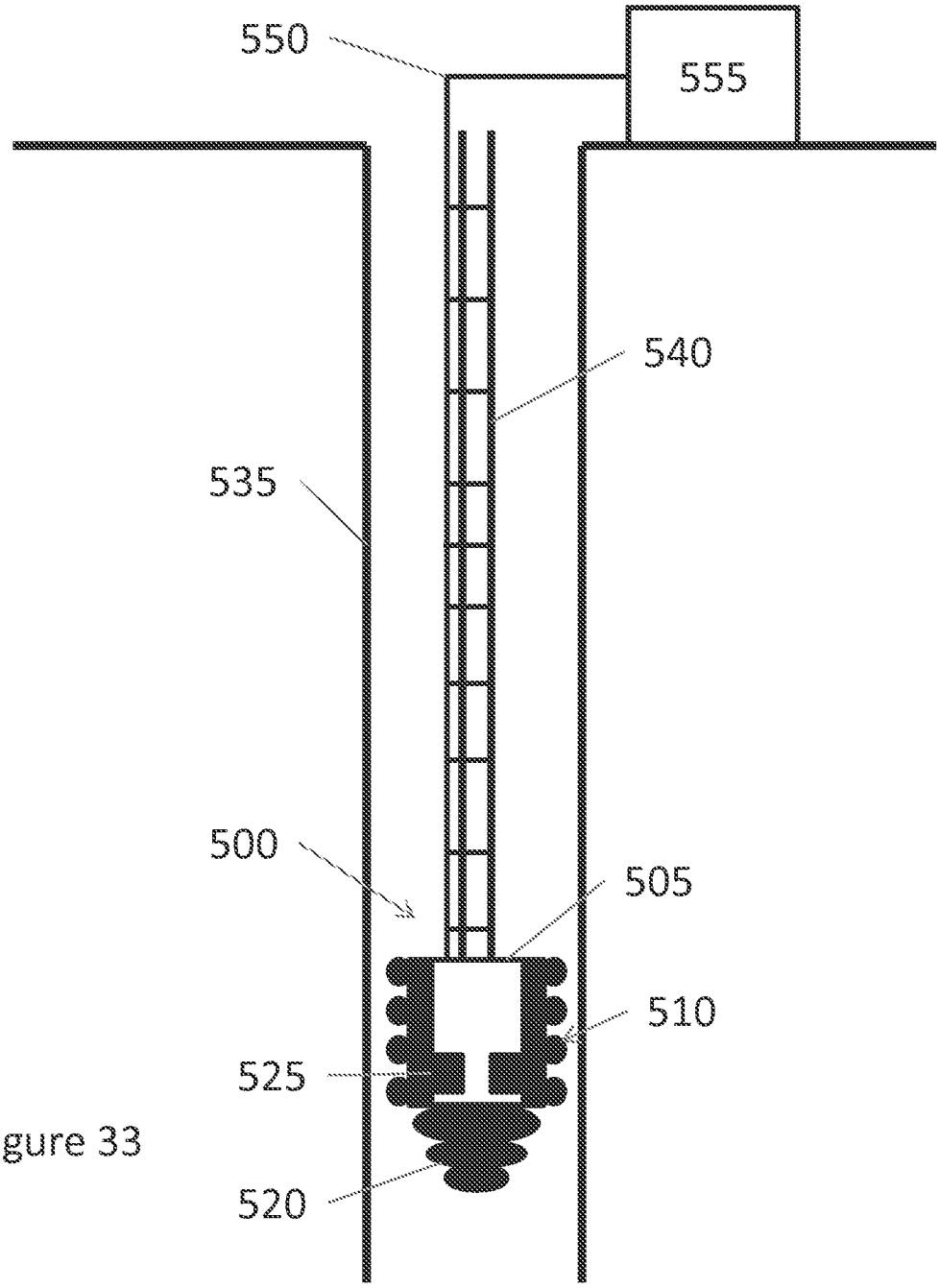
FIG. 33 is a cross-sectional view of a well according to embodiments of the present disclosure.

Referring to FIG. 33 a cross-sectional view of an automatic driller 500 disposed in a well is shown. In FIG. 33, an automatic driller 500 is shown as it is being disposed in a well 535 in a run-in-hole state. As described above in detail, automatic driller 500 includes a tool body 505 with a plurality of motive devices 510 disposed thereon. Automatic driller 500 also includes a drill bit 520 and setting tools 525. Automatic driller 500 may also include other various components that are not expressly illustrated. For example, automatic driller 500 may further include a rechargeable battery (not independently shown), a data controller or a programmable logic controller ("PLC") (not independently shown), a memory storage device (not independently shown), a wireless transmitter or transceiver (not independently shown), logging tools, and multiple sensors (not independently shown). Examples of sensors that may be included with automatic drill 500 include sensors that may measure a temperature, a pressure, a fluid type, specific gravity spinner, induction, conduction, refraction, infrared, a load, an acceleration, a velocity, a fiber optic signal, an ultrasonic signal, a tachometer measurement, a wireless transmission, a gyroscopic measurement, a casing collar locator, logging tools, imaging tools, modular dynamic testing tools, a modular reservoir dynamic test, and/or a position within the well.

In this embodiment, automatic driller 500 is illustrated being lowered into well 535 on a tubular 540 that may or may not have a central conduit 545. As such, an electric line 550 is connected to the outer diameter of tubular 540. In such an embodiment, the electric line 550 may be banded to tubular 540 using, for example, adhesives and/or mechanical connections that hold electric line 550 to tubular 540. Electric line 550 is configured to connect automatic driller 500 to a surface-based power source 555. The surface-based power source 555 may include a generator or other electric source capable of providing electricity to automatic driller 500 when automatic driller 500 is connected to tubular 540. While automatic driller 500 is shown connected to tubular 540, those of ordinary skill in the art will appreciate that automatic driller 500 may have an electrical input (not independently shown) that is configured to mate with a second electrical input (not independently shown) that is disposed on tubular 540. The mated first and second electrical inputs may thereby be used to provide power to automatic driller 500, thereby allowing a power source, such as a battery, of automatic driller 500 to be recharged.

During operation, the power source of automatic driller 500 may be charged or in a charging condition as automatic driller 500 is lowered into the well 535. During actuation of automatic driller 500, automatic driller 500 may disconnect from tubular 540, thereby allowing automatic driller 500 to run off its independent power source. Automatic driller 500 may then complete an operation, which will be discussed in detail below. When automatic driller 500 completes an operation or is otherwise low on power, automatic driller 500 may return and connect to tubular 540, thereby allowing the power source of automatic driller 500 to be recharged. Because tubular 540 is connected to a surface-based power source 555, the automatic driller 500 may be recharged numerous times before having to be returned to the surface. Thus, automatic driller 500 may perform multiple operations without requiring tripping of the tubular 540 and automatic driller 500. Also able to receive or transmit data, reprogram, or test equipment.

Figure 34:
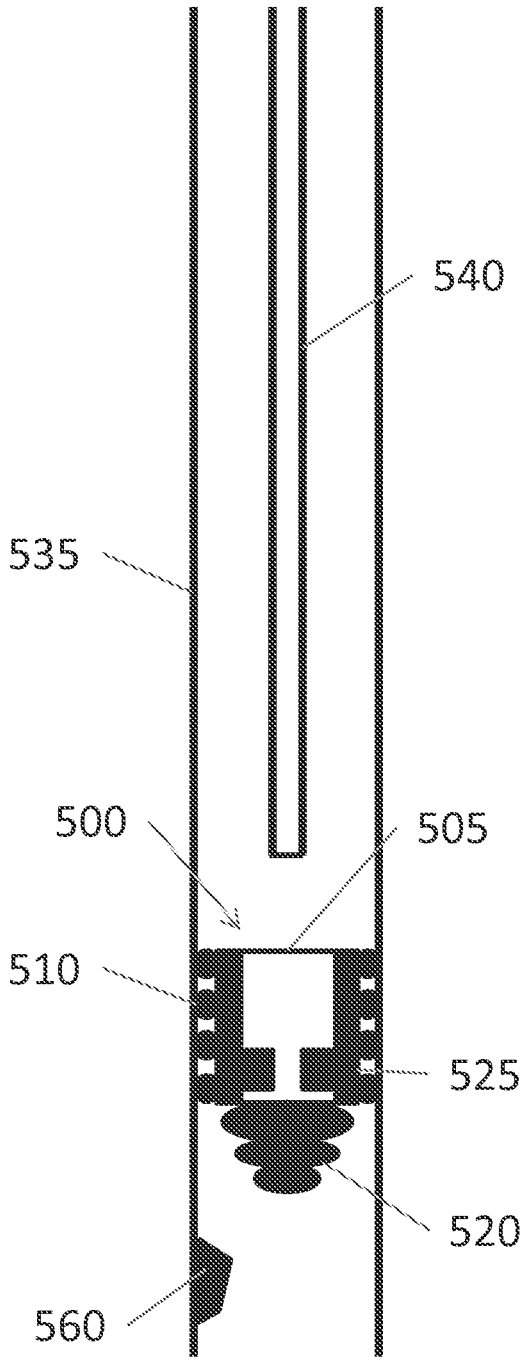
FIG. 34 is a cross-sectional view of a well according to embodiments of the present disclosure.

Referring to FIG. 34 a cross-sectional view of an automatic driller 500 disposed in a well is shown. As described above in detail, automatic driller 500 includes a tool body 505 with a plurality of motive devices 510 disposed thereon. Automatic driller 500 also includes a drill bit 520 and setting tools 525. Automatic driller 500 may also include other various components that are not expressly illustrated. For example, automatic driller 500 may further include a rechargeable battery (not independently shown), a data controller or a programmable logic controller ("PLC") (not independently shown), a memory storage device (not independently shown), a wireless transmitter or transceiver (not independently shown), logging tools, and multiple sensors (not independently shown). Examples of sensors that may be included with automatic drill 500 include sensors that may measure a temperature, a pressure, a fluid type, specific gravity spinner, induction, conduction, refraction, infrared, a load, an acceleration, a velocity, a fiber optic signal, an ultrasonic signal, a tachometer measurement, a wireless transmission, a gyroscopic measurement, a casing collar locator, logging tools, imaging tools, modular dynamic testing tools, a modular reservoir dynamic test, and/or a position within the well 535.

A first type of operation in which automatic driller 500 may be used is an operation intended to clean a portion of a well 535. In such an operation, automatic driller 500 may disconnect from tubular and move freely within the well 535. As automatic driller 500 moves within well 535, the sensors of automatic driller 500 may substantially continuously measure and/or log certain well parameters in order to determine which actuation of drill bit 520 is required in order to clear an obstruction 560. For example, automatic driller 500 may use sonar in order to determine if there is an obstruction 560 in well 535. In other embodiments, automatic driller 500 may determine a torque variance that indicates an obstruction 560 is blocking the path of automatic driller 500. In still other embodiments, proximity sensors may be used to determine an obstruction 560 is blocking the pack of automatic driller 500. Those of ordinary skill in the art will appreciate that any type of sensor may be used to determine whether an obstruction 560 is blocking the path of automatic driller 500. The types of sensing discussed herein are merely exemplary in nature and any other method of determining the location of an obstruction 560 may also be used.

Figure 35:
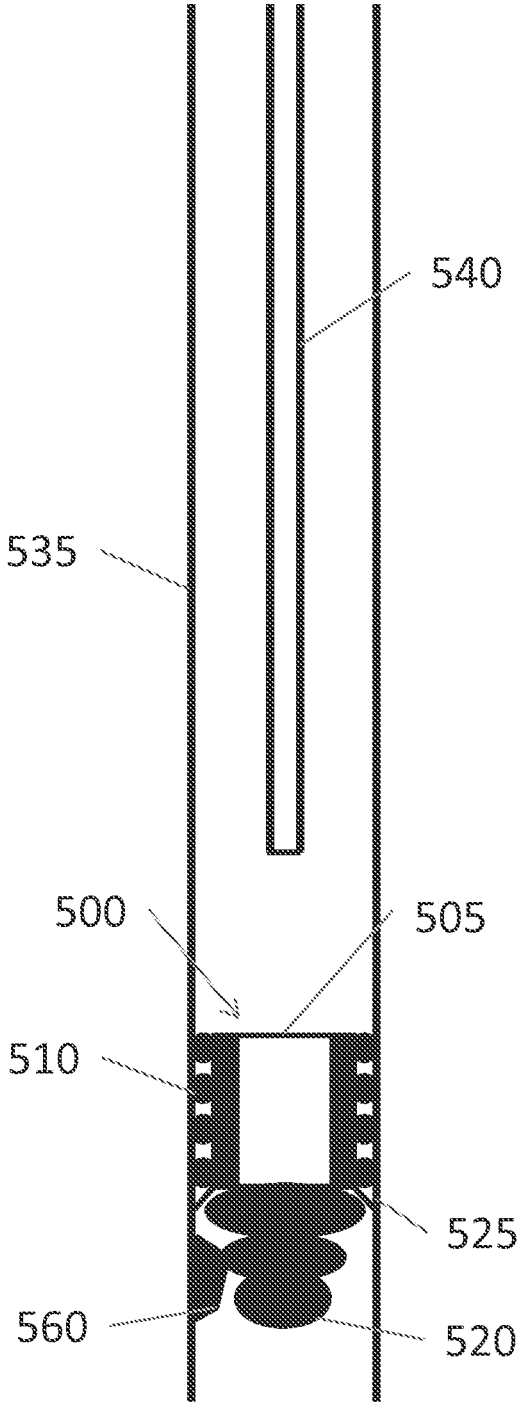
FIG. 35 is a cross-sectional view of a well according to embodiments of the present disclosure.

Referring to FIG. 35, a cross-sectional view of an automatic driller 500 disposed in a well is shown. As described above in detail, automatic driller 500 includes a tool body 505 with a plurality of motive devices 510 disposed thereon. Automatic driller 500 also includes a drill bit 520 and setting tools 525. Automatic driller 500 may also include other various components that are not expressly illustrated. For example, automatic driller 500 may further include a rechargeable battery (not independently shown), a data controller or a programmable logic controller ("PLC") (not independently shown), a memory storage device (not independently shown), a wireless transmitter or transceiver (not independently shown), logging tools, and multiple sensors (not independently shown). Examples of sensors that may be included with automatic drill 500 include sensors that may measure a temperature, a pressure, a fluid type, specific gravity spinner, induction, conduction, refraction, infrared, a load, an acceleration, a velocity, a fiber optic signal, an ultrasonic signal, a tachometer measurement, a wireless transmission, a gyroscopic measurement, a casing collar locator, logging tools, imaging tools, modular dynamic testing tools, a modular reservoir dynamic test, and/or a position within the well 535.

After an obstruction 560 is determined to be in well 535, automatic driller 500 may automatically actuate. Actuation of automatic driller 500 may include expanding drill bit 520 into an operational state. In certain embodiments, such as when drill bit 520 is not collapsed or compressed, drill bit 520 may not have to actuate into an operational state. In other embodiments, drill bit 520 may substantially continuously rotate as automatic driller 500 moves through well 535, thereby negating the need for the drill bit 520 to independently actuate. Regardless of whether a separate actuation step is required in order to facilitate the removal of obstruction 560, drill bit 520 may begin rotation in order to remove the obstruction 560.

In addition to actuation of drill bit 520, one or more setting tools 525 may be deployed. Deployment of setting tools 525 may include radially expanding one or more setting tools into contact with the well 535. During setting tool 525 deployment, the setting tools may stab into the well 535, thereby holding automatic driller 500 relatively in place within the well 535. As discussed above, setting tools 525 may be connected to one or more springs (not independently shown), or other types of mechanical, hydraulic, pneumatic, or pressurized locking mechanisms, thereby allowing automatic driller 500 to move longitudinally within the well 535, contacting the obstruction 560 multiple times, in order to facilitate drilling. Additionally, setting tools 525 may be used to bias automatic driller 500 in a position such that it can only move one direction within well 535. For example, when obstruction 560 is located lower in well 535 than automatic driller 500, setting tools 525 may prevent automatic driller 500 from moving longitudinally upward within well 535. As such, setting tools 525 may provide a force upon drill bit 520 similar to a weight on bit, which is typically applied in conventional drilling operations. The force applied to drill bit 520 may thereby facilitate the removal of obstruction 560 from the well 535. In certain embodiments, drill bit 520 may also be used in a pulsating manner to chip away an obstruction. In such a pulsating circumstance, the drill bit 520 may be moved into contact and then out of contact with the obstruction numerous times. Alternatively, the drill bit 520 may be actuated and then unactuated in a pulsating manner in order to clear the obstruction.

After the obstruction 560 is removed, automatic driller 500 may continue downward within well 535 clearing additional obstruction, if present. Additionally, drill bit 520 may be configured to continuously rotate such that if relatively small obstructions, such as sand deposits or other relatively small debris is encountered that might not otherwise cause an actuation operation, the obstruction is passively removed. Additionally, those of ordinary skill in the art will appreciate that relatively small debris may be removed by automatic driller running over, and thus loosening, the debris from the well 535.

After automatic driller 500 completes an operational cycle, the automatic driller 500 may return to tubular 540, reconnecting to tubular 540 and recharging its power source. In certain embodiments, automatic driller 500 may be connected to a continuous power source. In such an embodiment, rather than return to tubular 540, automatic driller may be directed to another job or stay at its current location recording and transmitting data about the environment downhole until it is needed for further jobs. Those of ordinary skill in the art will appreciate that an operational cycle may include a program predefined by automatic driller 500 to clear a portion of a well 535. In one embodiment, an operational cycle may include clearing a certain distance of a well 535. In other embodiments, an operational cycle may include moving within a well 535 to a certain position in order to take specific measurements or log a condition within the well. In still other embodiments, an operational cycle may include moving within a well 535 for a specified amount of time, while in still other embodiments, an operational cycle may refer to clearing a well 535 until power source level requires recharging. As such, the automatic driller 500 program may allow automatic driller 500 to operate substantially independently from the surface.

In certain embodiments, automatic driller 500 may be configured to receive additional input from the surface. In such embodiments, a surface operator may send instructions to automatic driller 500 to perform a desired operation. The instructions may be sent through, but not limited to, electric line (550 of FIGS. 32 and 33), through other wired connections, or wirelessly. Similarly, automatic driller 500 may send information to a surface operator through, but not limited to, electric line (550 of FIGS. 32 and 33), through other wired connections, or wirelessly. As such, automatic driller may be used to perform predefined operations, be instruction downhole, or be reprogrammed to perform different operations without having to trip the automatic driller 500 to the surface for reprogramming.

Figure 36:
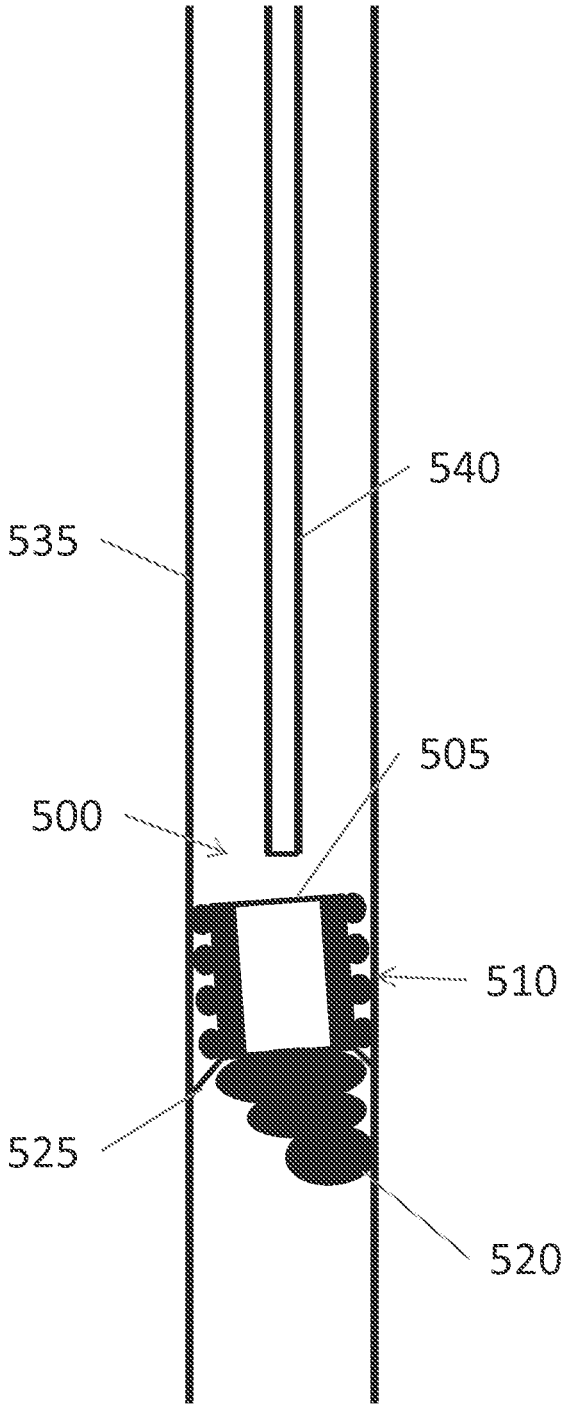
FIG. 36 is a cross-sectional view of a well according to embodiments of the present disclosure.

Referring to FIG. 36, a cross-sectional view of an automatic driller 500 disposed in a well is shown. As described above in detail, automatic driller 500 includes a tool body 505 with a plurality of motive devices 510 disposed thereon. Automatic driller 500 also includes a drill bit 520 and setting tools 525. Automatic driller 500 may also include other various components that are not expressly illustrated. For example, automatic driller 500 may further include a rechargeable battery (not independently shown), a data controller or a programmable logic controller ("PLC") (not independently shown), a memory storage device (not independently shown), a wireless transmitter or transceiver (not independently shown), logging tools, and multiple sensors (not independently shown). Examples of sensors that may be included with automatic drill 500 include sensors that may measure a temperature, a pressure, a fluid type, specific gravity spinner, induction, conduction, refraction, infrared, a load, an acceleration, a velocity, a fiber optic signal, an ultrasonic signal, a tachometer measurement, a wireless transmission, a gyroscopic measurement, a casing collar locator, logging tools, imaging tools, modular formation dynamic testing tools, a modular reservoir dynamic test, and/or a position within the well 535.

In this embodiment, automatic driller 500 is configured with a program to drill a secondary borehole. Secondary boreholes may be drilled in order to explore additional potential downhole reservoirs, as well as to laterally expand a well 535 in a different direction. For example, off of a single primary well 535, a number of secondary boreholes may be formed in order to reach additional hydrocarbon reservoirs without requiring drilling additional primary wells 535. Secondary boreholes may vary in inclination. For example, in certain wells 535, a secondary borehole may vary with a small angle of inclination with respect to the surface, while in certain wells 535, secondary boreholes may extend at approximately 90 degrees or more with respect to primary well 535. Additionally, those of ordinary skill in the art will appreciate that the angle of wells 535 vary greatly the deeper and/or longer the well. As such, wells 535 may have unintended angular inclination that may prevent typical downhole tools from moving freely within the well. In such wells 535, automatic driller 500 may allow sections of wells 535 to be reached that other tools may not be capable of reaching, as automatic driller 500 includes motive device 510, thereby allowing automatic driller to navigate wells 535 drilled with unintended angular inclination.

In this embodiment, automatic driller 500 is configured to drill a secondary borehole from well 535. In order to drill a secondary borehole, automatic driller 500 runs a program that actuates drill bit 520, substantially as described above. Along with actuation of drill bit 520, automatic driller may also deploy setting tools 525, however, rather than centralize drill bit 520 within well 535, setting tools 525 may be used to angle drill bit 520 and/or automatic driller 500 at a desired angle to cut a secondary borehole. In certain embodiments, setting tool 525 alone may angle automatic driller 500 within well 535 at the proper orientation to drill the desired angled secondary borehole. In other embodiments, drill bit 520 may be configured to rotate with respect to the tool body 505, thereby allowing drill bit 520 to cut at a desired angle with respect to well 535. In still other embodiments, such as the embodiment illustrated in FIG. 36, setting tools 535 may be deployed and drill bit 520 may be angled to achieve the desired drilling orientation.

Depending on the parameters of the well, drill bit 520 may be required to cut directly into formation, or alternatively, may be required to cut through casing and/or concrete in order to create the secondary borehole. Those of ordinary skill in the art will appreciate that the type of drill bit 520 used, including the type of cutters on the drill bit 520 may vary according to the well parameters. Additionally, in certain embodiments, fluids may be flowing through the well 535 in order to circulate the cuttings and cool the drill bit 520. Examples of fluids that may be present in well 535 may include, for example, water, brines, and hydrocarbons. Depending on the flow rate of fluids within the well, as well as drilling speed, additional fluids may be introduced form the surface of the well 535 in order to provide adequate fluid flow across the drill bit 520.

Figure 37:
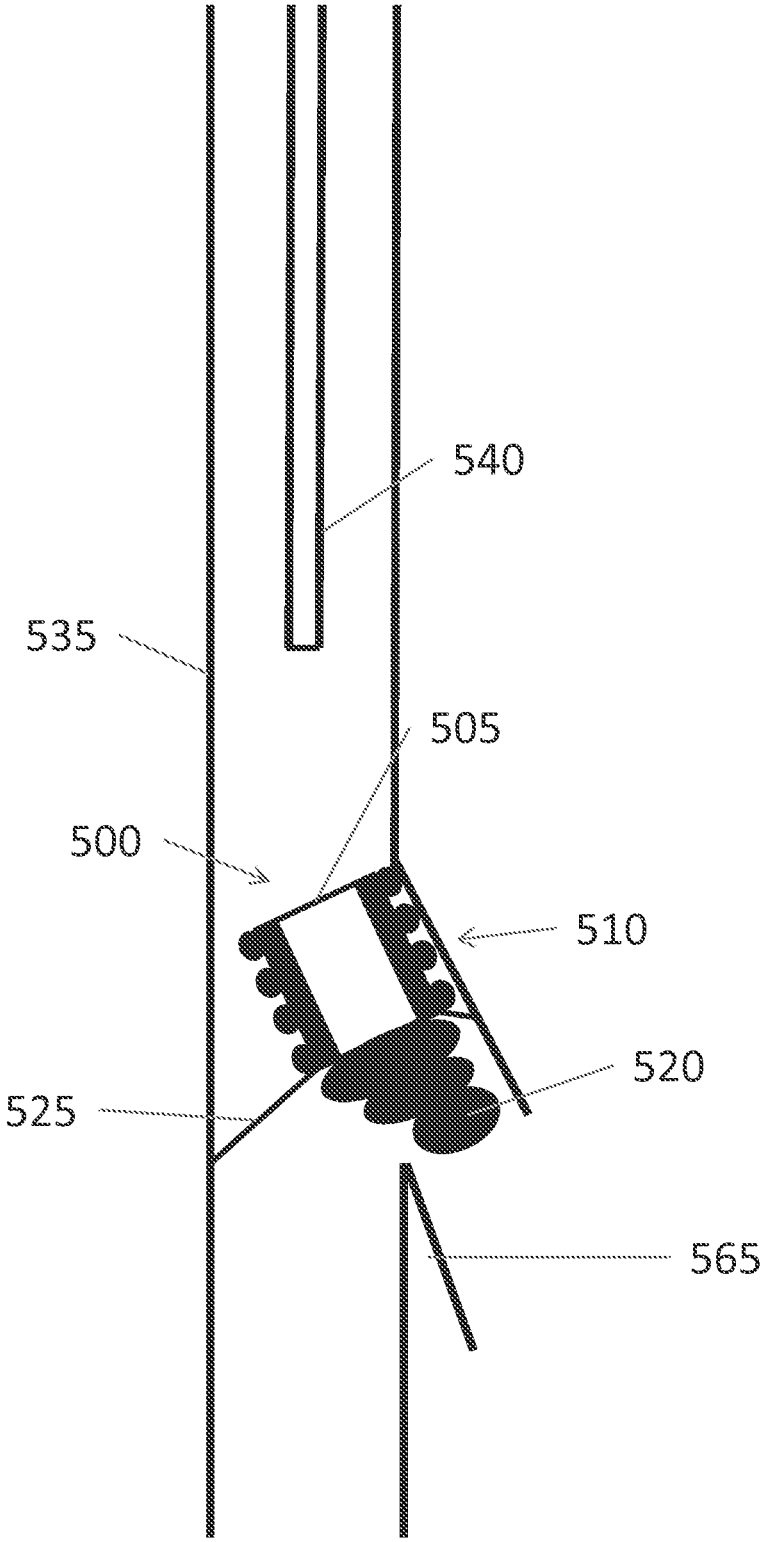
FIG. 37 is a cross-sectional view of a well according to embodiments of the present disclosure.

Referring to FIG. 37, a cross-sectional view of an automatic driller 500 disposed in a well is shown. As described above in detail, automatic driller 500 includes a tool body 505 with a plurality of motive devices 510 disposed thereon. Automatic driller 500 also includes a drill bit 520 and setting tools 525. Automatic driller 500 may also include other various components that are not expressly illustrated. For example, automatic driller 500 may further include a rechargeable battery (not independently shown), a data controller or a programmable logic controller ("PLC") (not independently shown), a memory storage device (not independently shown), a wireless transmitter or transceiver (not independently shown), and multiple sensors (not independently shown). Examples of sensors that may be included with automatic drill 500 include sensors that may measure a temperature, a pressure, a fluid type, specific gravity spinner, induction, conduction, refraction, infrared, a load, an acceleration, a velocity, a fiber optic signal, an ultrasonic signal, a tachometer measurement, a wireless transmission, a gyroscopic measurement, a casing collar locator, a modular reservoir dynamic test, and/or a position within the well 535.

As drill bit 520 cuts through the wall or casing of well 535, automatic driller 500 may continue drilling a secondary borehole 565. In order to allow automatic driller 500 to continue drilling secondary borehole 565, setting tools 525 may be configured to expand in certain directions and drill bit 520 may adjust its angle with respect to tool body 505, thereby allowing a relatively straight secondary borehole 565 to be drilled.

In addition to setting tools 525 and drill bit 520 being able to orient the automatic driller 500 to a correct angular inclination when drilling secondary borehole 565, the flexibility of tool body 505 may also facilitate the drilling of secondary borehole 565. As discussed above, tool body 505 may be formed from a material or through the use of appropriate components such that tool body 505 is capable of flexing. The flexibility of tool body 505 may thereby allow automatic driller 500 to navigate through tight angles, such as those that form when a secondary borehole 565 is initially drilled. For example, in certain embodiments tool body 500 may be configured to flex between 1° and 5° with respect to a central longitudinal axis of automatic driller 500. In other embodiments, tool body 500 may be configured to flex between 5° and 10° with respect to a central longitudinal axis of automatic driller 500. In still other embodiments, tool body 500 may be configured to flex greater than 10° with respect to a central longitudinal axis of automatic driller 500.

Depending on the hardness of the formation or substance being drilled, automatic driller 500 may either continuously drill till a desired depth is reached or may move in and out of the secondary borehole 565 in order to facilitate cutting and cuttings removal. Additionally, those of ordinary skill in the art will appreciate that depending on the type of secondary borehole 565 formed, as well as well parameters, automatic driller 500 may be required to return to tubular 540 periodically in order to recharge. If a recharge cycle is required, the programming of automatic driller 500 may allow automatic driller 500 to return to the secondary borehole 565 after completion of a recharge cycle.

Figure 38:
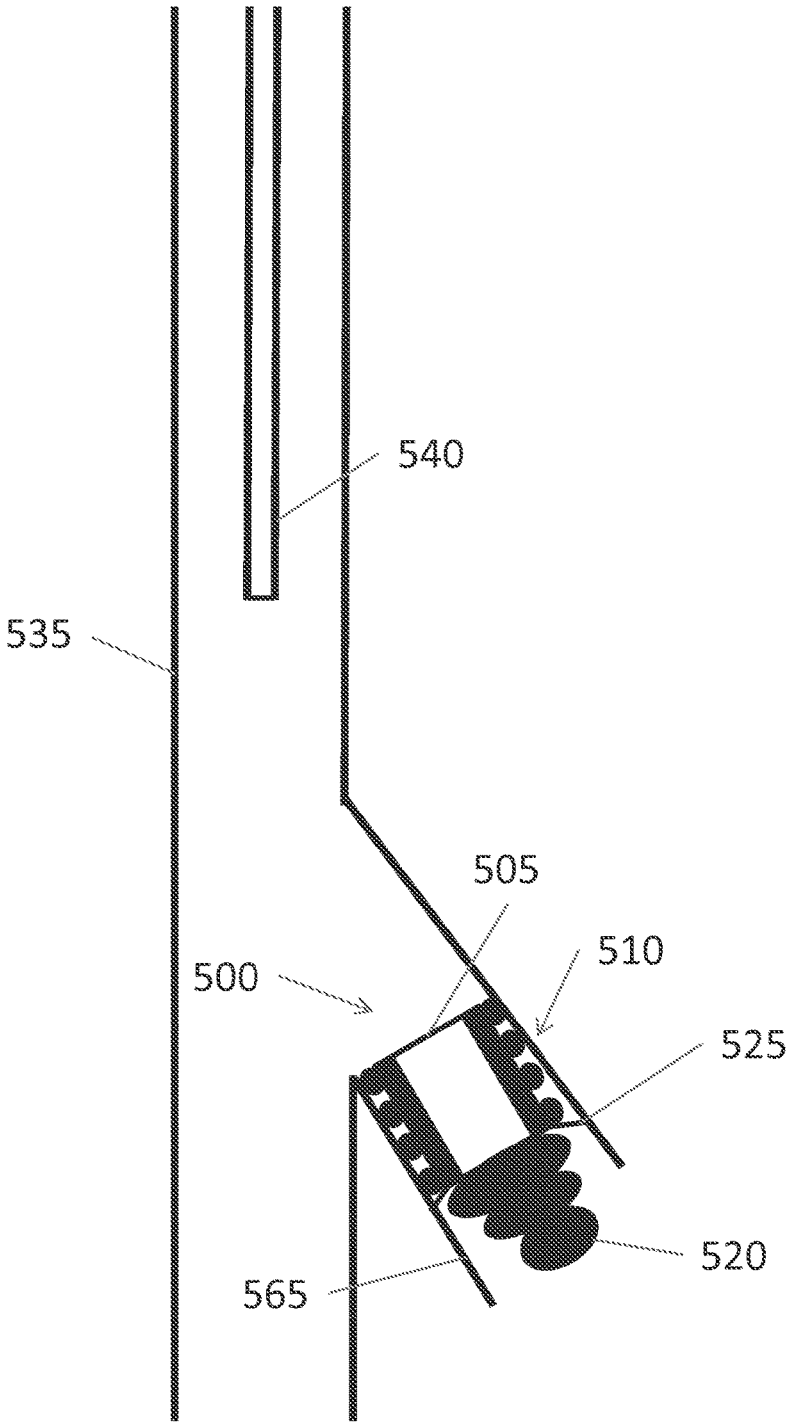
FIG. 38 is a cross-sectional view of a well according to embodiments of the present disclosure.

Referring to FIG. 38, a cross-sectional view of an automatic driller 500 disposed in a well is shown. As described above in detail, automatic driller 500 includes a tool body 505 with a plurality of motive devices 510 disposed thereon. Automatic driller 500 also includes a drill bit 520 and setting tools 525. Automatic driller 500 may also include other various components that are not expressly illustrated. For example, automatic driller 500 may further include a rechargeable battery (not independently shown), a data controller or a programmable logic controller ("PLC") (not independently shown), a memory storage device (not independently shown), a wireless transmitter or transceiver (not independently shown), and multiple sensors (not independently shown). Examples of sensors that may be included with automatic drill 500 include sensors that may measure a temperature, a pressure, a fluid type, specific gravity spinner, induction, conduction, refraction, infrared, a load, an acceleration, a velocity, a fiber optic signal, an ultrasonic signal, a tachometer measurement, a wireless transmission, a gyroscopic measurement, a casing collar locator, a modular reservoir dynamic test, and/or a position within the well 535.

After secondary borehole 565 is substantially opened to the desired angular inclination, automatic driller 500 may be configured to return to a normal drilling pattern, whereby drill bit 520 is aligned with tool body 505 and/or setting tools 525 are deployed to keep drill bit 520 concentric within the secondary borehole 565.

While the automatic driller 500 discussed above is limited to a discussion of a drill bit 520 that is run on electrical power, in other embodiments, drill bit 500 may be run on various other types of power. For example, in one embodiment, automatic driller 500 may actuate drill bit 520 using pressure, such as fluids e.g., gases. The fluids may be used to articulate a drive shaft of drill bit 520, thereby causing drill bit 520 to rotate relative to tool body 505. In other embodiments, automatic driller 500 may actuate drill bit 520 using a hydraulic pressure, such as hydraulic fluids. The hydraulic fluids may cycle between high pressure and low pressure tanks. Hydraulic fluid from the high pressure tank may thus be used to articular a drive shaft of the drill bit 520, thereby rotating the drill bit 520 with respect to the tool body 505. In still other embodiments, drill bit 520 may be actuated using mechanical mechanisms, such as one or more springs connected to drill bit 520. In such an embodiment, one or more springs may be connected to a drive shaft of drill bit 520. Prior to drilling, one or more of the springs may be compressed and while drilling, the springs may be put in tension, thereby imparting a rotational force to the drive shaft and rotating drill bit 520 with respect to tool body 505. In an embodiment using springs, multiple springs may be used, such that when one spring is in compression, one or more other springs may be in tension, thereby substantially continuously rotating the drive shaft of drill bit 520. Those of ordinary skill in the art will appreciate that additional methods of actuating drill bit 520 may also be used and are within the scope of the present disclosure.

Advantageously, embodiments of the present disclosure may allow for the automated setting of packing elements within wells. More specifically, embodiments of the present disclosure may allow an operator to determine where within a well a packer is to be set and deploy the packer directly into the well. Because the packer is deployed directly into the well, expensive and time consuming running tools may be avoided. For example, automatic packers according to embodiments disclosed herein may be released freely into the wellbore without the aid of tubing or wireline. Upon falling to a desired location within the well, the automatic packers may actuate without further signal from the surface. Embodiments disclosed herein may also provide an automatic packer that may temporarily isolate a portion of the well, gather data through sensors, and then release and return to the surface. The automatic packer may return to the surface through natural flow of the well or through the use of wireline or other motive means.

Figure 39:
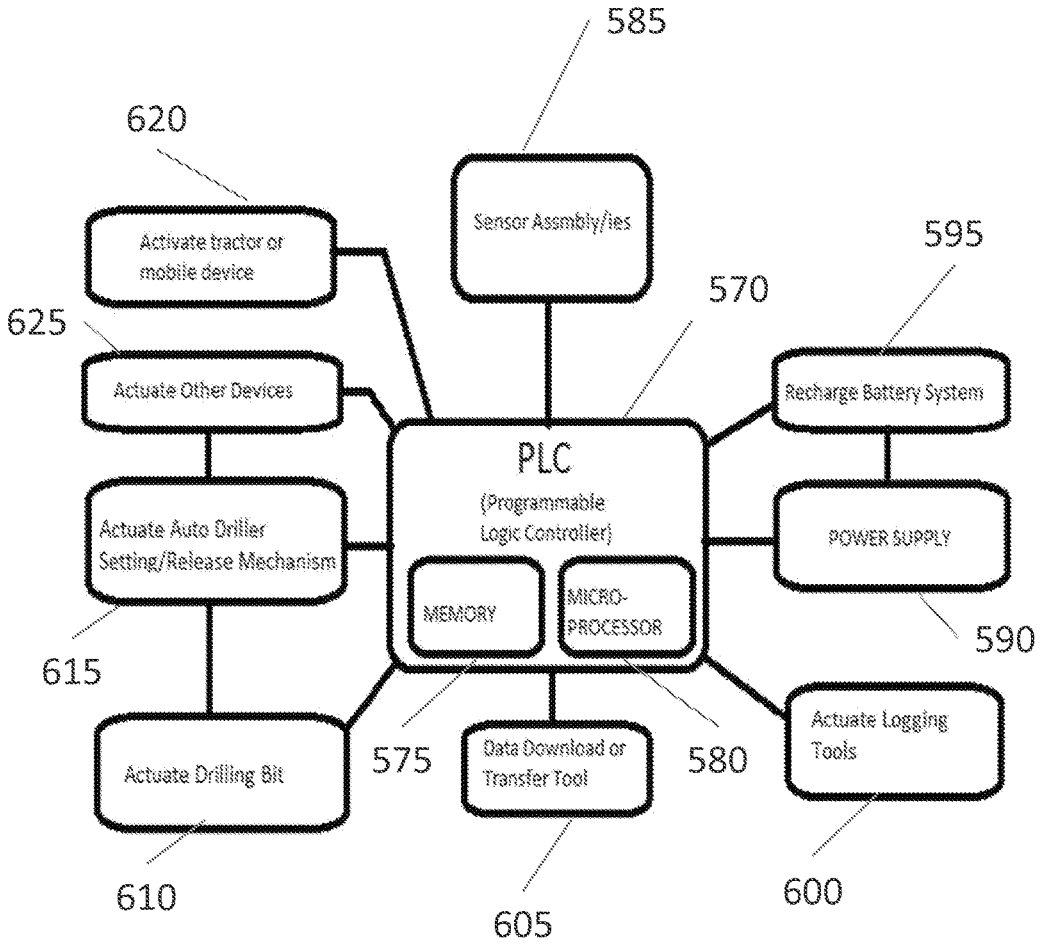
FIG. 39 is a block diagram of a control system for an automatic driller according to embodiments of the present disclosure.

Referring to FIG. 39, a block diagram of an automatic driller according to embodiments of the present disclosure is shown. Automatic driller includes a programmable logic controller (PLC) 570 and may be connected to or otherwise include memory 575 and one or more microprocessors 580. PLC 570 may be connected to various operational component sub-systems. Those of ordinary skill in the art will appreciate that in certain embodiments not all of the sub-systems may be present, while in other embodiments, all of the sub-systems, or a combination of various sub-systems may be present. Furthermore, in certain embodiments, additional sub-systems in addition to those expressly discussed here may be present.

In certain embodiments, PLC 570 may be connected to one or more sensors or sensor assemblies 585. Examples of sensors 585 that may be present include sensors 585 to measure a temperature, a pressure, a fluid type, specific gravity spinner, induction, conduction, refraction, infrared, a load, an acceleration, a velocity, a fiber optic signal, an ultrasonic signal, a tachometer measurement, a wireless transmission, a gyroscopic measurement, a casing collar locator, logging tools, imaging tools, modular formation dynamic testing tools, a modular reservoir dynamic test, and/or a position within the well. The sensors 585 may be connected directly to PLC 570 or may be connected to various other sub-systems in order to provide data to the sub-systems.

PLC 570 may also be connected to a power supply sub-system. The power supply sub-system may include a power supply 590, such as a battery. Power supply 590 may be connected to a battery recharge system 595. The battery recharge system 595 may include various components that allow power supply 590 to be recharged, either substantially continuously or through external components. In certain embodiments, one or more of the power supply 590 and the battery recharge system 595 may be connected to an external power source, thereby providing the automatic driller a substantially continuous power supply. In other embodiments, battery recharge system 595 may include one or more of components to recharge power supply 590 by downhole heat induction, flowing phases through a turbine or turbine blades, kinetic recharging, movement, etc.

PLC 570 may also be connected to one or more logging tools 600. Examples of logging tools may include tools that provide electrical logs, porosity logs, lithology logs, logging while drilling, memory logs, and various other types of logs. Specific examples of the types of devices that may be used to log conditions downhole include gamma ray logging, spontaneous potential logging, resistivity logging, density logging, sonic logging, caliper logging, mud logging, nuclear magnetic resonance logging, neutron porosity logging, image logging, and the like. The logged data may be stored in the logging tools 600, sent to the PLC 570 for further processing, or otherwise sent to the surface for analysis.

PLC 570 may also include a data download/transfer tool sub-system 605. The data download/transfer tool sub-system 605 may include devices that allow for the automatic driller to interact with other tools, either downhole or at the surface. For example, in certain embodiments, automatic driller may return data collected downhole to the surface while automatic driller is still downhole. In such a circumstance, the transfer tool 605 may interface with a wire or other electrical conduit, thereby allowing the automatic driller to return information collected to the surface. Similarly, transfer tool 605 may be used to provide automatic driller instructions from the surface without the need to remove the automatic driller from the well. In still other embodiments, data download/transfer tool sub-system 605 may include wireless connections, thereby allowing the automatic driller to transfer information wirelessly to the surface.

PLC 570 may also be connected to various tool actuation sub-systems, such as drilling bit actuation 610, automatic driller setting/release mechanisms 615, motive device systems 620, and other device systems 625. The PLC 570 may provide instructions that are either received from the surface or stored in the memory 575 to control one or more of the actuation sub-systems. For example, PLC 570 may include instructions for actuating a drill bit or deactivating a drill bit. The PLC 570 may further include instructions for setting or releasing the automatic driller, instructions for controlling the motive aspects of the automatic driller, or for actuating or deactivating various other devices of the automatic driller. Examples of other aspects of the automatic driller that may be controlled using the PLC 570 may include sensor actuation, logging actuation, packer device actuation, etc.

Advantageously, embodiments of the present disclosure may allow for substantially automated perforation operations to be completed within wells. Upon isolation of a section of a well, an extendable perforator may be released from an automatic packer. The extendable perforator may then longitudinally expand within the well bore, spacing charges as the extendable perforated extends. Upon signal from the surface, based on timing, or based on the fulfillment of predefined criteria, the perforator may be discharged, thereby perforating the well.

Advantageously, embodiments of the present disclosure may allow for packers to be automatically set based on a number of measured criteria. For example, sensors on the automatic packer may measure a temperature, a pressure, a fluid type, a load, an acceleration, a velocity, a tachometer measurement, a casing collar locator measurement, a modular reservoir dynamic test measurement, and/or a position. When a predefined criteria is met, e.g., a density, specific gravity, induction, conduction, refraction, infrared, a specific temperature, fluid type, load, acceleration, velocity, a tachometer measurement, a casing collar measurement, a modular reservoir dynamic test measurement, and/or position is measured, the packer may be set to automatically actuate.

Advantageously, embodiments of the present disclosure may provide for one trip isolation and perforation of sections of a well. Because the perforator is extendable from the packer, after actuation of the packer, perforation may occur without running a separate perforator into the well.

Advantageously, embodiments of the present disclosure may provide for one trip isolation and perforation of single and multiple sections of a well that will help assist on fracture or treatment jobs of a well. Because the perforator is extendable from the packer, after actuation of the packer, perforation may occur without running a separate perforator run into the well and may be able to continue fracturing multiple stages by perforating and isolating each stage with minimal downtime. Such a one trip system may thus increase efficiency and reduce cost.

Also advantageously, embodiments of the present disclosure may provide for one trip isolation and perforation systems that allow for actuation of devices in a section of a well. Such devices may thus be capable of isolating deviated and lateral parts of a well by having a tractor or mobile device that may take the devices to the depth required.

Advantageously, embodiments of the present disclosure may provide for one trip isolation, perforation, data recordation, transmission of data to surface, release of packer, and removal of the packer at the surface of a well. Additionally, apparatuses disclosed herein may provide devices that can temporarily or permanently isolate, perforate, gather data and recover packer by automatic control and or wireless commands.

Advantageously, embodiments of the present disclosure may provide for a substantially self-acting driller to be disposed in a well in order to facilitate clearing obstructions from a well that may decrease production efficiency.

Advantageously, embodiments of the present disclosure may provide for a self-acting driller to be disposed in a well in order to drill secondary boreholes without control from a surface operator.

Advantageously, embodiments of the present disclosure may provide for an automatic downhole tool that can receive programming from the surface by wire or wirelessly and execute the program downhole without additional surface control.

Advantageously, embodiments of the present disclosure may provide for an automatic driller that, once downhole, does not require a return trip to the surface to recharge. Because the automatic driller does not require tripping and can recharge while downhole, the process of cleaning a well of obstructions may be more efficient and may occur on a more frequent basis. Advantageously, the return of the automatic driller to the surface may include collapsing one or more components of the automatic driller and returning the automatic driller to the surface using, for example, wireline or a pressure differential within the well.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. An automatic drilling apparatus comprising:

a tool body;

a motive device connected to the tool body;

a drill bit connected to the tool body;

a setting tool connected to the tool body and independent of the motive device;

at least one sensor disposed on the tool body; and a computer disposed in the tool body, wherein the computer is configured to independently actuate the motive device, the drill bit, the setting tool, and the at least one sensor.

2. The automatic drilling apparatus of claim 1, further comprising a power source disposed in the tool body and connected to the computer.

3. The automatic drilling apparatus of claim 2, further wherein the power source is rechargeable through kinetic recharging.

4. The automatic drilling apparatus of claim 1, wherein the sensor is configured to measure at least one of a temperature, a pressure, a fluid type, a load, a density, a specific gravity, an induction, a conduction, a refraction, an infrared signal, a fiber optic signal, an acceleration, a velocity, a wireless transmission, a gyroscopic measurement, an ultrasonic signal, a tachometer measurement, a casing collar locator, a logging tool, a imaging tool, a modular formation dynamic testing tool, and a modular reservoir dynamic test.

5. The automatic drilling apparatus of claim 1, further comprising a second drill bit disposed at an opposite end of the tool body from the drill bit.

6. The automatic drilling apparatus of claim 1, wherein the drill bit is collapsible within at least a portion of the tool body.

7. The automatic drilling apparatus of claim 1, wherein the drill bit is compressible within at least a portion of the tool body.

8. The automatic drilling apparatus of claim 1, wherein the automatic drilling apparatus is configured to connect to an electric wire that provides electricity from the surface of a well to the automatic drilling apparatus.

9. The automatic drilling apparatus of claim 1, wherein the automatic drilling apparatus is configured to recharge by movement, heat, or fluid/phase flow through turbine blades.

10. The automatic drilling apparatus of claim 1, wherein the automatic drilling; apparatus is configured to recharge at the surface.

11. The automatic drilling apparatus of claim 1, wherein the motive device comprises a track.

12. The automatic drilling apparatus of claim 1, wherein the drill hit is configured to sidetrack a secondary borehole in a well.

13. The automatic drilling apparatus of claim 1, wherein the motive device comprises wheels.

14. The automatic drilling apparatus of claim 1, wherein the tool body is configured to flex during operation to conform to a profile of a well.

15. The automatic drilling apparatus of claim 14, wherein the tool body is configured to flex between 1 and 5 degrees of a central longitudinal axis of the automatic driller.

16. The automatic drilling apparatus of claim 1, wherein the drill bit is a radially expandable drill bit.

17. The automatic drilling, apparatus of claim 1, further comprising at least two motive devices, wherein the two motive devices are configured to move the automatic drilling apparatus within a wellbore.

18. The automatic drilling apparatus of claim 1, wherein the setting tool comprises radially expandable portions that are unexpanded in a run-in-hole state.

19. The automatic drilling apparatus of claim 1, wherein the setting tool is configured to angle the automatic drilling apparatus to a specified angle.

20. The automatic drilling apparatus of claim 1, wherein the setting tool comprises radially expandable projections.

* * * * *